US011502408B2

(12) United States Patent
Yasuo et al.

(10) Patent No.: US 11,502,408 B2
(45) Date of Patent: Nov. 15, 2022

(54) SCANNED ANTENNA AND LIQUID CRYSTAL DEVICE

(71) Applicant: SHARP KABUSHIKI KAISHA, Osaka (JP)

(72) Inventors: Fumitoshi Yasuo, Osaka (JP); Kenichi Kitoh, Osaka (JP); Shinya Kadono, Osaka (JP); Junichi Inukai, Osaka (JP)

(73) Assignee: SHARP KABUSHIKI KAISHA, Osaka (JP)

( * ) Notice: Subject to any disclaimer, the term of this patent is extended or adjusted under 35 U.S.C. 154(b) by 464 days.

(21) Appl. No.: 16/854,522

(22) Filed: Apr. 21, 2020

(65) Prior Publication Data

US 2020/0343633 A1 Oct. 29, 2020

Related U.S. Application Data

(60) Provisional application No. 62/838,661, filed on Apr. 25, 2019.

(51) Int. Cl.
*H01Q 21/06* (2006.01)
*H01Q 3/36* (2006.01)

(52) U.S. Cl.
CPC ..... *H01Q 3/36* (2013.01); *H01Q 21/064* (2013.01); *H01Q 21/065* (2013.01)

(58) Field of Classification Search
CPC ..... H01Q 21/064; H01Q 21/065; H01Q 3/44; H01Q 21/055; G09G 3/36
See application file for complete search history.

(56) References Cited

U.S. PATENT DOCUMENTS 7,466,269 B2 12/2008 Haziza
7,847,894 B2 12/2010 Rho
(Continued)

FOREIGN PATENT DOCUMENTS

JP 2002-217640 A 8/2002
JP 2005-107127 A 4/2005
(Continued)

OTHER PUBLICATIONS

R. A. Stevenson et al., "Rethinking Wireless Communications: Advanced Antenna Design using LCD Technology", SID 2015 DIGEST, pp. 827-830.
(Continued)

*Primary Examiner* — Ricardo I Magallanes
(74) *Attorney, Agent, or Firm* — ScienBiziP, P.C.

(57) ABSTRACT

A liquid crystal device includes a first substrate (TFT substrate) including a first dielectric substrate, a second substrate (slot substrate) including a second dielectric substrate, a liquid crystal layer provided between the first substrate and the second substrate and in all of an effective region and a portion of a non-effective region, a sealing seal portion configured to define the maximum value of the area of the liquid crystal layer when viewed from a normal direction of the first or second dielectric substrate, a cell gap control seal portion configured to define the minimum value of the thickness of the liquid crystal layer in the effective region, and a buffer portion provided in contact with the liquid crystal layer in the non-effective region and that deforms more easily due to external force than the first and second dielectric substrates in the effective region. The buffer portion includes a sheet and a joining section that joins the sheet and the first or second dielectric substrate. The sheet deforms more easily due to external force than the first and second dielectric substrates in the effective region,
(Continued)

and/or at least a portion of the joining section deforms more easily due to external force than the cell gap control seal portion.

20 Claims, 50 Drawing Sheets

(56) References Cited

U.S. PATENT DOCUMENTS

| | | | | |
|---|---|---|---|---|
| 2012/0092577 | A1 | 4/2012 | Shi et al. | |
| 2012/0194399 | A1 | 8/2012 | Bily et al. | |
| 2018/0294542 | A1 | 10/2018 | Minoura et al. | |
| 2018/0337446 | A1 | 11/2018 | Nakazawa et al. | |
| 2019/0036227 | A1 * | 1/2019 | Linn | H01Q 21/00 |

FOREIGN PATENT DOCUMENTS

| | | | | |
|---|---|---|---|---|
| JP | 2007-116573 | A | 5/2007 | |
| JP | 2007-295044 | A | 11/2007 | |
| JP | 2009-538565 | A | 11/2009 | |
| JP | 2013-539949 | A | 10/2013 | |
| WO | 2007/139736 | A2 | 12/2007 | |
| WO | 2012/050614 | A1 | 4/2012 | |
| WO | 2014/149341 | A1 | 9/2014 | |
| WO | 2015/126550 | A1 | 8/2015 | |
| WO | 2015/126578 | A1 | 8/2015 | |
| WO | 2016/057539 | A1 | 4/2016 | |
| WO | 2016/130383 | A1 | 8/2016 | |
| WO | 2016/141340 | A1 | 9/2016 | |
| WO | 2016/141342 | A1 | 9/2016 | |
| WO | 2017/061527 | A1 | 4/2017 | |
| WO | 2017/065088 | A1 | 4/2017 | |
| WO | WO-2017142032 | A1 * | 8/2017 | G02F 1/13 |

OTHER PUBLICATIONS

M. Ando et al., "A Radial Line Slot Antenna for 12GHz Satellite TV Reception", IEEE Transactions of Antennas and Propagation, vol. AP-33, No. 12, pp. 1347-1353 (1985).

M. Wittek et al., "Liquid Crystals for Smart Antennas and Other Microwave Applications", SID 2015 DIGESTpp.824-826.

Kuki, "New Functional Element Using Liquid Crystal" Polymer, vol. 55, August issue, pp. 599-602 (2006) (A concise explanation of the relevance can be found in paragraph [0101] of the Description of the subject application).

Co-Pending letter regarding a related co-pending U.S. Appl. No. 15/542,488, filed Jul. 10, 2017.

* cited by examiner

SCANNED ANTENNA AND LIQUID CRYSTAL DEVICE

CROSS-REFERENCE TO RELATED APPLICATIONS

This application claims the benefit of priority to U.S. Provisional Application No. 62/838,661 filed on Apr. 25, 2019. The entire contents of the above-identified application are hereby incorporated by reference.

BACKGROUND

Technical Field

The disclosure relates to a scanning antenna, more particularly, to a scanning antenna having antenna units (also referred to as an "element antennas") with liquid crystal capacitance (also referred to as a "liquid crystal array antenna") and a manufacturing method of the scanning antenna. The disclosure also relates to a liquid crystal device, such as a liquid crystal display device.

Antennas for mobile communication and satellite broadcasting require functions that can change the beam direction (referred to as "beam scanning" or "beam steering"). As an example of an antenna (hereinafter referred to as a "scanning antenna" (scanned antenna) having such functionality, phased array antennas equipped with antenna units are known. However, known phased array antennas are expensive, which is an obstacle for popularization as a consumer product. In particular, as the number of antenna units increases, the cost rises considerably.

In order to solve this problem, scanning antennas that use the high dielectric anisotropy (birefringence index) of liquid crystal materials (including nematic liquid crystals and polymer dispersed liquid crystals) have been proposed (JP 2007-116573 A, JP 2007-295044 A, JP 2009-538565 T, JP 2013-539949 T, WO 2015/126550, and R. A. Stevenson et al., "Rethinking Wireless Communications: Advanced Antenna Design using LCD Technology", SID 2015 DIGEST, pp. 827-830). Because the dielectric constant of liquid crystal material exhibits frequency dispersion, in the present specification, the dielectric constant in a microwave frequency band (also referred to as "dielectric constant for microwaves") is particularly designated as a "dielectric constant $M(\varepsilon_{H})$".

JP 2009-538565 T and R. A. Stevenson et al., "Rethinking Wireless Communications: Advanced Antenna Design using LCD Technology", SID 2015 DIGEST, pp. 827-830 describe an inexpensive scanning antenna obtained using technology for a liquid crystal display device (hereinafter referred to as "LCD").

The present inventors have developed a scanning antenna which can be mass-manufactured by utilizing known manufacturing techniques of LCDs. WO 2017/061527 of the application applied by the applicant discloses a scanning antenna which can be mass-manufactured by utilizing the known manufacturing techniques of LCDs, a TFT substrate used for such a scanning antenna, and a manufacturing method and driving method of such a scanning antenna. For reference, the entire contents of the disclosures of WO 2017/061527 are incorporated herein.

SUMMARY

According to study by the present inventors, there is a problem in that changes in environmental temperature adversely affect antenna performance in a scanning antenna provided with a liquid crystal panel, such as that described in WO 2017/061527. This problem in that changes in environmental temperature adversely affect the antenna performance of a scanning antenna will be described in detail later.

In light of the above, an object of the disclosure is to suppress a decrease in the antenna performance of a scanning antenna provided with a liquid crystal panel due to environmental temperature. Another object of the disclosure is not limited to a scanning antenna and is to reduce influence on liquid crystal device function in a liquid crystal device such as a liquid crystal display device caused by changes in the thickness of a liquid crystal layer.

According to the embodiments of the disclosure, there are provided solutions according to the following items.

Item 1

A scanning antenna including:

a transmission and/or reception region including a plurality of antenna units;

a non-transmission and/or reception region other than the transmission and/or reception region;

a TFT substrate including a first dielectric substrate and, supported by the first dielectric substrate, a plurality of TFTs, a plurality of gate bus lines, a plurality of source bus lines, and a plurality of patch electrodes;

a slot substrate including a second dielectric substrate and a slot electrode formed on a first main surface of the second dielectric substrate and including a plurality of slots arranged corresponding to the plurality of patch electrodes;

a liquid crystal layer provided between the TFT substrate and the slot substrate and in all of the transmission and/or reception region and a portion of the non-transmission and/or reception region;

a sealing seal portion surrounding the liquid crystal layer and configured to define a maximum value of area of the liquid crystal layer when viewed from a normal direction of the first dielectric substrate or the second dielectric substrate;

a cell gap control seal portion configured to define a minimum value of thickness of the liquid crystal layer in the transmission and/or reception region;

a reflective conductive plate disposed opposing a second main surface of the second dielectric substrate on a side opposite the first main surface via a dielectric layer; and at least one buffer portion provided in contact with the liquid crystal layer in the non-transmission and/or reception region and deforming more easily due to external force than the first dielectric substrate and the second dielectric substrate in the transmission and/or reception region, in which the at least one buffer portion includes a sheet and a joining section configured to join the sheet and the first dielectric substrate or the second dielectric substrate, and the sheet deforms more easily due to external force than the first dielectric substrate and the second dielectric substrate in the transmission and/or reception region, and/or at least a portion of the joining section deforms more easily due to external force than the cell gap control seal portion.

Item 2

The scanning antenna according to item 1, further including a plurality of columnar spacers provided in the transmission and/or reception region, in which the cell gap control seal portion is configured to define a minimum value of thickness of the liquid crystal layer in the transmission and/or reception region together with the plurality of columnar spacers.

Item 3

The scanning antenna according to item 1 or 2, in which the sealing seal portion is configured to define a minimum value of thickness of the liquid crystal layer in the non-transmission and/or reception region.

Item 4

The scanning antenna according to item 3, in which a minimum value of thickness of the liquid crystal layer in the transmission and/or reception region defined by the cell gap control seal portion and a minimum value of thickness of the liquid crystal layer in the non-transmission and/or reception region defined by the sealing seal portion are substantially equal.

Item 5

The scanning antenna according to item 3, in which the sealing seal portion includes the cell gap control seal portion.

Item 6

The scanning antenna according to item 1 or 2, in which at least a portion of the sealing seal portion deforms more easily due to external force than the cell gap control seal portion, and the at least one buffer portion further includes the at least a portion of the sealing seal portion.

Item 7

The scanning antenna according to any one of items 1 to 4 and 6, in which the cell gap control seal portion is disposed in the non-transmission and/or reception region inward of the sealing seal portion and includes a plurality of portions arranged discretely around the transmission and/or reception region and an opening between adjacent portions among the plurality of portions.

Item 8

The scanning antenna according to any one of items 1 to 7, in which the sheet includes a polymer film.

Item 9

The scanning antenna according to any one of items 1 to 7, in which the sheet includes a thin metal film.

Item 10

The scanning antenna according to any one of items 1 to 7, in which the sheet includes a glass sheet.

Item 11

The scanning antenna according to any one of items 1 to 10, in which, in the non-transmission and/or reception region, the first dielectric substrate or the second dielectric substrate includes at least one thin portion at which thickness of the first dielectric substrate or the second dielectric substrate is smaller than a thickness in the transmission and/or reception region, the at least one buffer portion further includes the at least one thin portion, and the sheet overlaps the at least one thin portion when viewed from the normal direction of the first dielectric substrate or the second dielectric substrate.

Item 12

The scanning antenna according to item 11, in which the at least one thin portion entirely overlaps the joining section and the sheet when viewed from the normal direction of the first dielectric substrate or the second dielectric substrate.

Item 13

The scanning antenna according to item 11 or 12, in which the second dielectric substrate includes the at least one thin portion, and the second main surface of the second dielectric substrate includes at least one recessed portion defining the at least one thin portion.

Item 14

The scanning antenna according to any one of items 11 to 13, in which the thickness of the at least one thin portion of the second dielectric substrate is equal to or less than 0.1 mm.

Item 15

The scanning antenna according to any one of items 11 to 14, in which the thickness of the at least one thin portion of the second dielectric substrate is equal to or less than 0.05 mm.

Item 16

The scanning antenna according to any one of items 1 to 15, in which the first dielectric substrate or the second dielectric substrate includes at least one through-hole in the non-transmission and/or reception region, and the sheet covers the at least one through-hole.

Item 17

The scanning antenna according to item 16, in which the sheet is disposed further from the liquid crystal layer than the first dielectric substrate or the second dielectric substrate formed with the at least one through-hole.

Item 18

The scanning antenna according to item 17, in which the sealing seal portion includes at least a portion of the joining section.

Item 19

The scanning antenna according to item 17 or 18, in which the at least a portion of the joining section deforms more easily due to external force than the cell gap control seal portion.

Item 20

The scanning antenna according to item 16, in which the sheet is disposed closer to the liquid crystal layer than the first dielectric substrate or the second dielectric substrate formed with the at least one through-hole.

Item 21

The scanning antenna according to item 20, in which a surface of the sheet closer to the liquid crystal layer includes a plurality of protruding portions and/or a plurality of recessed portions in contact with the liquid crystal layer.

Item 22

The scanning antenna according to any one of items 1 to 10, in which one of the first dielectric substrate and the second dielectric substrate includes at least one protrusion that does not overlap the other of the first dielectric substrate and the second dielectric substrate when viewed from the normal direction of the first dielectric substrate or the second dielectric substrate, and the sheet is joined to the at least one protrusion and the other of the first dielectric substrate and the second dielectric substrate via the joining section.

Item 23

The scanning antenna according to item 22, in which the sealing seal portion includes at least a portion of the joining section.

Item 24

A liquid crystal device including:

an effective region and a non-effective region located in a region other than the effective region;

a first substrate including a first dielectric substrate;

a second substrate including a second dielectric substrate;

a liquid crystal layer provided between the first substrate and the second substrate and in all of the effective region and a portion of the non-effective region;

a sealing seal portion surrounding the liquid crystal layer and configured to define a maximum value of area of the liquid crystal layer when viewed from a normal direction of the first dielectric substrate or the second dielectric substrate;

a cell gap control seal portion configured to define a minimum value of thickness of the liquid crystal layer in the effective region; and at least one buffer portion provided in contact with the liquid crystal layer in the non-effective region and deforming more easily due to external force than the first dielectric substrate and the second dielectric substrate in the effective region, in which the at least one buffer portion includes a sheet, and a joining section joining the sheet and the first dielectric substrate or the second dielectric substrate, and the sheet deforms more easily due to external force than the first dielectric substrate and the second dielectric substrate in the effective region, and/or at least a portion of the joining section deforms more easily due to external force than the cell gap control seal portion.

According to one embodiment of the disclosure, it is possible to suppress decrease in the antenna performance of a scanning antenna provided with a liquid crystal panel due to environmental temperature. According to another embodiment of the disclosure, it is possible to reduce influence on liquid crystal device function in a liquid crystal device such as a liquid crystal display device caused by changes in the thickness of a liquid crystal layer.

BRIEF DESCRIPTION OF DRAWINGS

The disclosure will be described with reference to the accompanying drawings, wherein like numbers reference like elements.

DESCRIPTION OF EMBODIMENTS

Figure 1:
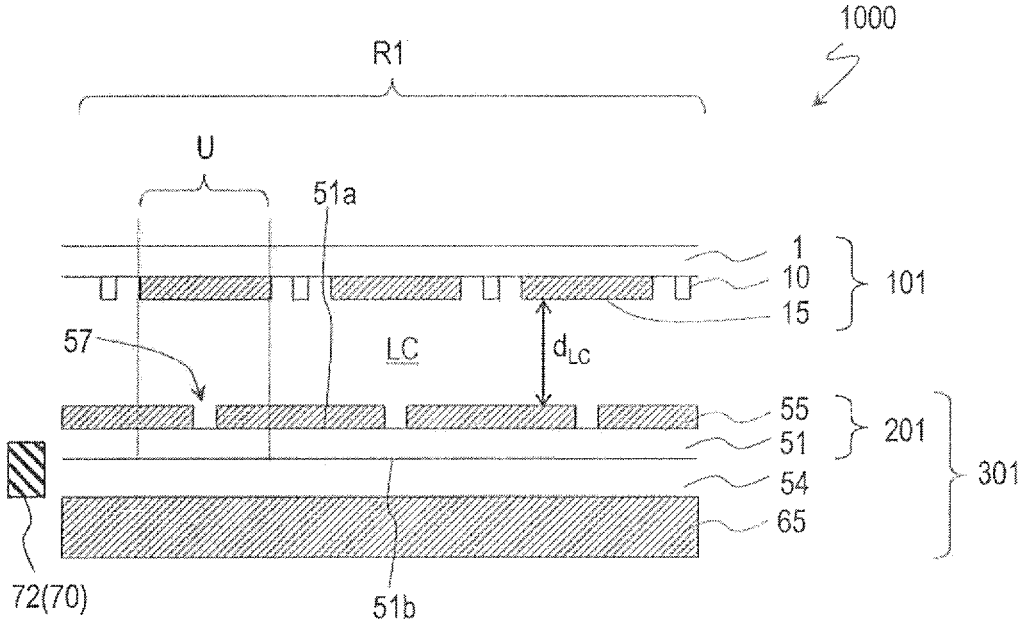
FIG. 1 is a cross-sectional view schematically illustrating a portion of a scanning antenna 1000.

Hereinafter, a scanning antenna, a manufacturing method of the scanning antenna, and a TFT substrate used for the scanning antenna according to embodiments of the disclosure will be described with reference to the drawings. Note that the disclosure is not limited to the embodiments illustrated below. The embodiments of the disclosure are not limited to the drawings. For example, a thickness of a layer in a cross-sectional view, sizes of a conductive portion and an opening in a plan view, and the like are exemplary.

Basic Structure of Scanning Antenna

A scanning antenna that uses antenna units employing the high anisotropy (birefringence index) of the dielectric constant $M(_{\varepsilon M})$ of liquid crystal material controls the voltage applied to liquid crystal layers in the antenna units associated with individual pixels in an LCD panel and varies the effective dielectric constant $M(_{\varepsilon M})$ of the liquid crystal layer in each antenna unit, to thereby form a two-dimensional pattern with antenna units having different electrostatic capacitance (corresponding to display of an image by the LCD). An electromagnetic wave (for example, a microwave) emitted from an antenna or received by an antenna is given a phase difference depending on the electrostatic capacitance of each antenna unit and gains a strong directivity in a particular direction depending on the two-dimensional pattern formed by the antenna units having different electrostatic capacitances (beam scanning). For example, an electromagnetic wave emitted from an antenna is obtained by integrating, with consideration for the phase difference provided by each antenna unit, spherical waves obtained as a result of input electromagnetic waves entering each antenna unit and being scattered by each antenna unit. It can be considered that each antenna unit functions as a "phase shifter." For a description of the basic structure and operating principles of a scanning antenna that uses liquid crystal material, refer to JP 2007-116573 A, JP 2007-295044 A, JP 2009-538565 T, JP 2013-539949 T, R. A. Stevenson et al., "Rethinking Wireless Communications: Advanced Antenna Design using LCD Technology", SID 2015 DIGEST, pp. 827-830, and M. ANDO et al., "A Radial Line Slot Antenna for 12 GHz Satellite TV Reception", IEEE Transactions of Antennas and Propagation, Vol. AP-33, No. 12, pp. 1347-1353 (1985). M. ANDO et al., "A Radial Line Slot Antenna for 12 GHz Satellite TV Reception", IEEE Transactions of Antennas and Propagation, Vol. AP-33, No. 12, pp. 1347-1353 (1985) describes the basic structure of a scanning antenna provided with an array of spiral slots. For reference, the entire contents disclosed in JP 2007-116573 A, JP 2007-295044 A, JP 2009-538565 T, JP 2013-539949 T, R. A. Stevenson et al., "Rethinking Wireless Communications: Advanced Antenna Design using LCD Technology", SID 2015 DIGEST, pp. 827-830, and M. ANDO et al., "A Radial Line Slot Antenna for 12 GHz Satellite TV Reception", IEEE Transactions of Antennas and Propagation, Vol. AP-33, No. 12, pp. 1347-1353 (1985) are incorporated herein.

Note that although the antenna units in the scanning antenna are similar to pixels in an LCD panel, the structure of the antenna units is different from the structure of pixels in an LCD panel, and the arrangement of the plurality of antenna units is also different from the arrangement of pixels in an LCD panel. A basic structure of the scanning antenna will be described with reference to FIG. 1, which illustrates a scanning antenna 1000 described in WO 2017/061527. The scanning antenna 1000 is a radial in-line slot antenna in which slots are concentrically arranged. However, the scanning antenna according to embodiments of the disclosure is not limited thereto. For example, the slots may be arranged in any known arrangement. In particular, with respect to the slot and/or antenna unit arrangements, the entire disclosure of WO 2015/126550 is incorporated herein by reference.

FIG. 1 is a cross-sectional view schematically illustrating a portion of the scanning antenna 1000 and schematically illustrates a partial cross-section taken along a radial direction from a power feed pin 72 (see FIG. 2B) provided at or near the center of the concentrically arranged slots.

The scanning antenna 1000 includes a TFT substrate 101, a slot substrate 201, a liquid crystal layer LC provided therebetween, and a reflective conductive plate 65 opposing the slot substrate 201 with an air layer 54 interposed between the slot substrate 201 and the reflective conductive plate 65. The scanning antenna 1000 transmits and/or receives microwaves to and/or from a side closer to the TFT substrate 101.

The TFT substrate 101 includes a dielectric substrate 1 such as a glass substrate, a plurality of patch electrodes 15 and a plurality of TFTs 10 formed on the dielectric substrate 1. Each patch electrode 15 is connected to a corresponding TFT 10. Each TFT 10 is connected to a gate bus line and a source bus line.

The slot substrate 201 includes a dielectric substrate 51 such as a glass substrate and a slot electrode 55 formed on a side of the dielectric substrate 51 closer to the liquid crystal layer LC. The slot electrode 55 includes a plurality of slots 57. The slot electrode 55 is formed on a first main surface 51*a* of the dielectric substrate 51.

The reflective conductive plate 65 is disposed opposing the slot substrate 201 with the air layer 54 interposed between the reflective conductive plate 65 and the slot substrate 201. The reflective conductive plate 65 is disposed opposing a second main surface 51*b* opposite the first main surface 51*a* of the dielectric substrate 51, for example, with the air layer 54 interposed therebetween. In place of the air layer 54, a layer formed of a dielectric (e.g., a fluorine resin such as PTFE) having a small dielectric constant M for microwaves can be used. The slot electrode 55, the reflective conductive plate 65, and the dielectric substrate 51 and the air layer 54 therebetween function as a waveguide 301.

The patch electrode 15, the portion of the slot electrode 55 including the slot 57, and the liquid crystal layer LC therebetween constitute an antenna unit U. In each antenna unit U, one patch electrode 15 opposes a portion of the slot electrode 55 including one slot 57 with the liquid crystal layer LC interposed therebetween, thereby constituting liquid crystal capacitance. The structure in which the patch electrode 15 and the slot electrode 55 oppose each other with the liquid crystal layer LC interposed therebetween is similar to the structure in which the pixel electrode and the counter electrode in an LCD panel oppose each other with the liquid crystal layer interposed therebetween. That is, the antenna unit U of the scanning antenna 1000 and the pixel in an LCD panel have a similar configuration. The antenna unit has a configuration similar to that of the pixel in an LCD panel in that the antenna unit has an auxiliary capacitance electrically connected in parallel with the liquid crystal capacitance. However, the scanning antenna 1000 has many differences from the LCD panel.

First, the performance required for the dielectric substrates 1 and 51 of the scanning antenna 1000 is different from the performance required for the substrate of the LCD panel.

Generally, transparent substrates that are transparent to visible light are used for LCD panels. For example, glass substrates or plastic substrates are used. In reflective LCD panels, since the substrate on the back side does not need transparency, a semiconductor substrate may be used in some cases. In contrast to this, it is preferable for the dielectric substrates 1 and 51 used for the antennas to have small dielectric losses with respect to microwaves (where the dielectric tangent with respect to microwaves is denoted as tan $\delta_M$). The tan $\delta_M$ of each of the dielectric substrates 1 and 51 is preferably approximately less than or equal to 0.03, and more preferably less than or equal to 0.01. Specifically, a glass substrate or a plastic substrate can be used. Glass substrates are superior to plastic substrates in terms of dimensional stability and heat resistance and are suitable for forming circuit elements such as TFTs, wiring lines, and electrodes using LCD technology. For example, in a case where the materials forming the waveguide are air and glass, as the dielectric loss of glass is greater, from the viewpoint that thinner glass can reduce the waveguide loss, it is preferable for the thickness to be less than or equal to 400 μm, and more preferably less than or equal to 300 μm. There is no particular lower limit, provided that the glass can be handled such that it does not break in the manufacturing process.

The conductive material used for the electrode is also different. In many cases, an ITO film is used as a transparent conductive film for pixel electrodes and counter electrodes of LCD panels. However, ITO has a large tan $\delta_M$ with respect to microwaves, and as such cannot be used as the conductive layer in an antenna. The slot electrode 55 functions as a wall for the waveguide 301 together with the reflective conductive plate 65. Accordingly, to suppress the transmission of microwaves in the wall of the waveguide 301, it is preferable that the thickness of the wall of the waveguide 301, that is, the thickness of the metal layer (Cu layer or Al layer) be large. It is known that in a case where the thickness of the metal layer is three times the skin depth, electromagnetic waves are attenuated to 1/20 (−26 dB), and in a case where the thickness is five times the skin depth, electromagnetic waves are attenuated to about 1/150 (−43 dB). Accordingly, in a case where the thickness of the metal layer is five times the skin depth, the transmittance of electromagnetic waves can be reduced to 1%. For example, for a microwave of 10 GHz, in a case where a Cu layer having a thickness of greater than or equal to 3.3 μm and an Al layer having a thickness of greater than or equal to 4.0 μm are used, microwaves can be reduced to 1/150. In addition, for a microwave of 30 GHz, in a case where a Cu layer having a thickness of greater than or equal to 1.9 μm and an Al layer having a thickness of greater than or equal to 2.3 μm are used, microwaves can be reduced to 1/150. In this way, the slot electrode 55 is preferably formed of a relatively thick Cu layer or Al layer. There is no particular upper limit for the thickness of the Cu layer or the Al layer, and the thicknesses can be set appropriately in consideration of the time and cost of film formation. The usage of a Cu layer provides the advantage of being thinner than the case of using an Al layer. Relatively thick Cu layers or Al layers can be formed not only by the thin film deposition method used in LCD manufacturing processes, but also by other methods such as bonding Cu foil or Al foil to the substrate. The thickness of the metal layer, for example, ranges from 2 μm to 30 μm. In a case where the thin film deposition methods are used, the thickness of the metal layer is preferably less than or equal to 5 μm. Note that aluminum plates, copper plates, or the like having a thickness of several mm can be used as the reflective conductive plate 65, for example.

Since the patch electrode 15 does not configure the waveguide 301 like the slot electrode 55, a Cu layer or an Al layer can be used that has a smaller thickness than that of the slot electrode 55. However, to avoid losses caused by heat when the oscillation of free electrons near the slot 57 of the slot electrode 55 induces the oscillation of the free electrons in the patch electrode 15, it is preferable that the resistance be low. From the viewpoint of mass manufacture, it is preferable to use an Al layer rather than a Cu layer, and the thickness of the Al layer is preferably greater than or equal to 0.3 μm and less than or equal to 2 μm, for example.

The arrangement pitch of the antenna units U is considerably different from that of the pixel pitch. For example, considering an antenna for microwaves of 12 GHz (Ku band), the wavelength λ is 25 mm, for example. Assuming this, as described in JP 2013-539949 T, the arrangement pitch is less than or equal to 6.25 mm and/or less than or equal to 5 mm because the pitch of the antenna unit U is less than or equal to λ/4 and/or less than or equal to λ/5. This is ten times greater than the pitch of pixels in an LCD panel. Accordingly, the length and width of the antenna unit U are also roughly ten times greater than the pixel length and width of the LCD panel.

Of course, the array of the antenna units U may be different from the array of the pixels in the LCD panel. Herein, although an example is illustrated in which the antenna units U are arranged in a concentric circle (for example, refer to JP 2002-217640 A), the present disclosure is not limited thereto, and the antenna units U may be arranged in a spiral as described in, for example, M. ANDO et al., "A Radial Line Slot Antenna for 12 GHz Satellite TV Reception", IEEE Transactions of Antennas and Propagation, Vol. AP-33, No. 12, pp. 1347-1353 (1985). Furthermore, the antenna units U may be arranged in a matrix as described in JP 2013-539949 T.

The properties required for the liquid crystal material of the liquid crystal layer LC of the scanning antenna 1000 are different from the properties required for the liquid crystal material of the LCD panel. In the LCD panel, a change in refractive index of the liquid crystal layer of the pixels allows a phase difference to be provided to the polarized visible light (wavelength from 380 nm to 830 nm) such that the polarization state is changed (for example, allowing the polarization axis direction of linearly polarized light to be rotated or the degree of circular polarization of circularly polarized light to be changed), whereby display is performed. In contrast, in the scanning antenna 1000, the phase of the microwave excited (re-radiated) from each patch electrode is changed by changing the electrostatic capacitance value of the liquid crystal capacitance of the antenna unit U. Accordingly, the liquid crystal layer preferably has a high anisotropy ($\Delta_{\varepsilon M}$) of the dielectric constant M ($_{\varepsilon M}$) for microwaves, and tan $\delta_M$ is preferably small. For example, a liquid crystal material having a nm of 4 or greater and a tan $\delta_M$ of 0.02 or less (values of 19 Gz in both cases) as described by M. Wittek et al., SID 2015 DIGEST, pp.

824-826 can be suitably used. In addition, a liquid crystal material having a $\Delta_{\varepsilon M}$ of 0.4 or greater and a tan $\delta_M$ of 0.04 or less as described by Kuki in the August issue of Polymers, Vol. 55, pp. 599-602 (2006) can be used.

In general, the dielectric constant of a liquid crystal material has frequency dispersion, but the dielectric anisotropy $\Delta_{\varepsilon M}$ for microwaves has a positive correlation with refractive index anisotropy Δn with respect to visible light. Accordingly, it can be said that a material having a large refractive index anisotropy Δn with respect to visible light is preferable as a liquid crystal material for an antenna unit for microwaves. The refractive index anisotropy Δn of the liquid crystal material for LCDs is evaluated by the refractive index anisotropy for light having a wavelength of 550 nm. Here again, when Δn (birefringence index) is used as an index for light having a wavelength of 550 nm, a nematic liquid crystal having a Δn of greater than or equal to 0.3, preferably greater than or equal to 0.4, can be used for an antenna unit for microwaves. The value Δn has no particular upper limit. However, because liquid crystal materials with a large Δn tend to have strong polarity, reliability may decrease. The thickness of the liquid crystal layer is, for example, from 1 μm to 500 μm.

Hereinafter, the structure of the scanning antenna will be described in more detail.

Figure 2A:
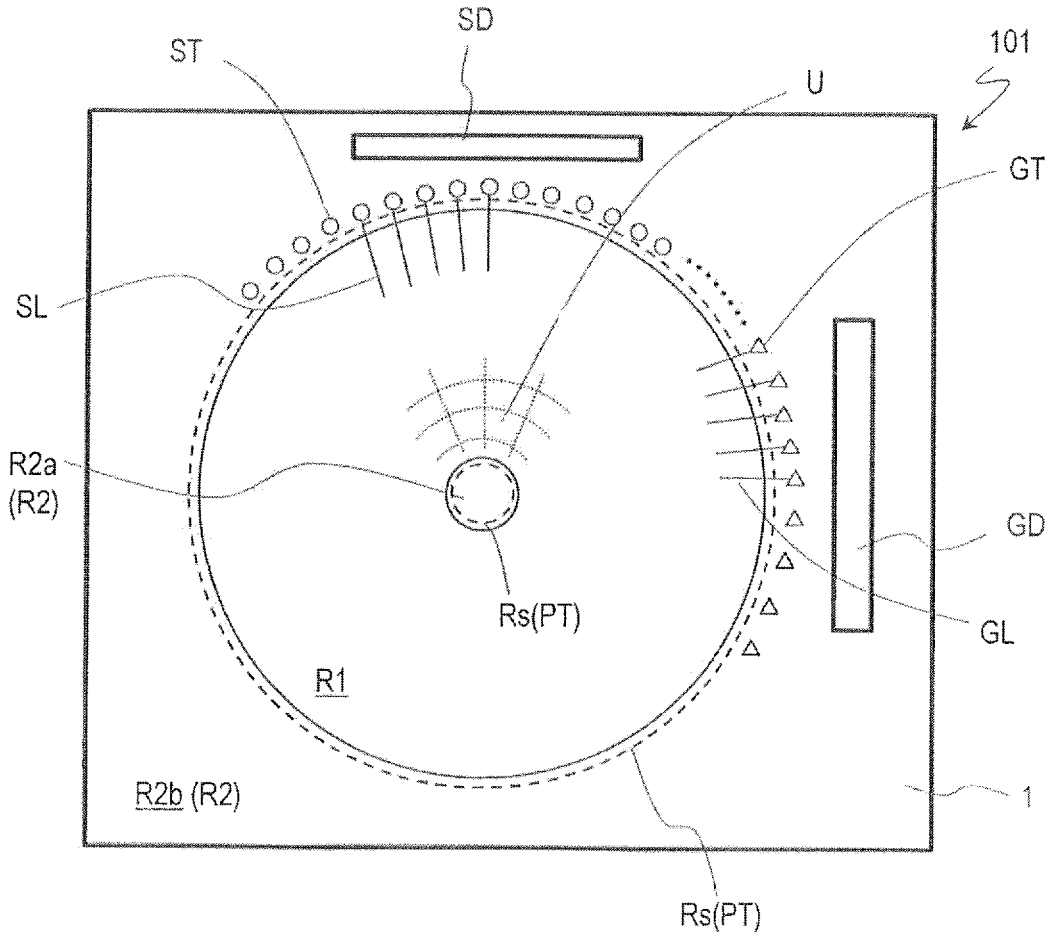
FIG. 2A is a schematic plan view illustrating a TFT substrate 101 included in the scanning antenna 1000.
Figure 2B:
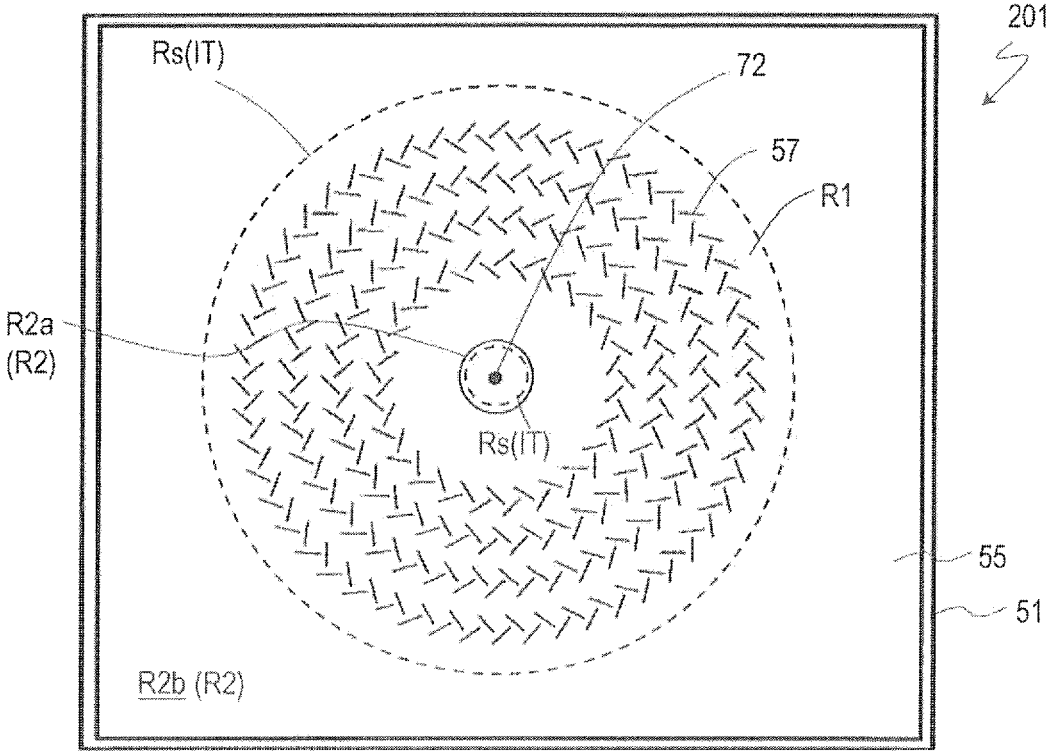
FIG. 2B is a schematic plan view illustrating a slot substrate 201 included in the scanning antenna 1000.

First, a description is given with reference to FIGS. 1, 2A, and 2B. FIG. 1 is a schematic partial cross-sectional view of the scanning antenna 1000 near the center of the scanning antenna 1000 as described above in detail, and FIGS. 2A and 2B are schematic plan views illustrating the TFT substrate 101 and the slot substrate 201 included in the scanning antenna 1000, respectively.

The scanning antenna 1000 includes a plurality of the antenna units U arranged two-dimensionally. In the scanning antenna 1000 exemplified here, the plurality of antenna units U are arranged concentrically. In the following description, the region of the TFT substrate 101 and the region of the slot substrate 201 corresponding to the antenna unit U will be referred to as "antenna unit region," and be denoted with the same reference numeral U as the antenna unit. In addition, as illustrated in FIGS. 2A and 2B, a region defined by a plurality of two-dimensionally arranged antenna unit regions in each of the TFT substrate 101 and the slot substrate 201 is referred to as a "transmission and/or reception region R1," and a region other than the transmission and/or reception region R1 is referred to as a "non-transmission and/or reception region R2." A terminal section, a driving circuit, and the like are provided in the non-transmission and/or reception region R2.

FIG. 2A is a schematic plan view illustrating the TFT substrate 101 included in the scanning antenna 1000.

In the illustrated example, the transmission and/or reception region R1 has a donut-shape when viewed from a normal direction of the TFT substrate 101. The non-transmission and/or reception region R2 includes a first non-transmission and/or reception region R2*a* located at the center of the transmission and/or reception region R1 and a second non-transmission and/or reception region R2*b* located at a peripheral portion of the transmission and/or reception region R1. An outer diameter of the transmission and/or reception region R1, for example, is from 200 mm to 1500 mm and is configured according to communication traffic volume or other factors.

A plurality of gate bus lines GL and a plurality of source bus lines SL supported by the dielectric substrate 1 are provided in the transmission and/or reception region R1 of the TFT substrate 101, and the antenna unit regions U are defined by these wiring lines. The antenna unit regions U are, for example, arranged concentrically in the transmission and/or reception region R1. Each of the antenna unit regions U includes a TFT and a patch electrode electrically connected to the TFT. The source electrode of the TFT is electrically connected to the source bus line SL, and the gate electrode is electrically connected to the gate bus line GL. In addition, the drain electrode is electrically connected to the patch electrode.

In the non-transmission and/or reception region R2 (R2*a*, R2*b*), a seal region Rs is disposed surrounding the transmission and/or reception region R1. A sealing member is applied to the seal region Rs. The sealing member bonds the TFT substrate 101 and the slot substrate 201 and encapsulates liquid crystals between the TFT substrate 101 and the slot substrate 201.

A gate terminal section GT, a gate driver GD, a source terminal section ST, and a source driver SD are provided outside a region of the non-transmission and/or reception region R2 surrounded by the seal region Rs. Each of the gate bus lines GL is connected to the gate driver GD with the gate terminal section GT therebetween. Each of the source bus lines SL is connected to the source driver SD with the source terminal section ST therebetween. Note that, in this example, although the source driver SD and the gate driver GD are formed on the dielectric substrate 1, one or both of these drivers may be provided on another dielectric substrate.

Also, a plurality of transfer terminal sections PT are provided in the non-transmission and/or reception region R2. The transfer terminal sections PT are electrically connected to the slot electrode 55 (FIG. 2B) of the slot substrate 201. In the present specification, the connection section between the transfer terminal sections PT and the slot electrode 55 is referred to as a "transfer section." As illustrated in the drawings, the transfer terminal sections PT (transfer section) may be disposed in the seal region Rs. In this case, a resin containing conductive particles may be used as the sealing member. In this way, liquid crystals are sealed between the TFT substrate 101 and the slot substrate 201, and an electrical connection can be secured between the transfer terminal sections PT and the slot electrode 55 of the slot substrate 201. In this example, although a transfer terminal section PT is disposed in both the first non-transmission and/or reception region R2*a* and the second non-transmission and/or reception region R2*b*, the transfer terminal sections PT may be disposed in only one of the first non-transmission and/or reception region R2*a* and the second non-transmission and/or reception region R2*b*.

Note that the transfer terminal sections PT (transfer sections) need not be disposed in the seal region Rs. For example, the transfer terminal sections PT may be disposed in a region of the non-transmission and/or reception region R2 other than the seal region Rs. Needless to say, the transfer sections may be disposed both within the seal region Rs and outside the seal region Rs.

FIG. 2B is a schematic plan view illustrating the slot substrate 201 in the scanning antenna 1000 and illustrates the surface of the slot substrate 201 closer to the liquid crystal layer LC.

In the slot substrate 201, the slot electrode 55 is formed on the dielectric substrate 51 extending across the transmission and/or reception region R1 and the non-transmission and/or reception region R2.

In the transmission and/or reception region R1 of the slot substrate 201, the plurality of slots 57 are formed in the slot electrode 55. The slots 57 are formed corresponding to the antenna unit regions U on the TFT substrate 101. For the plurality of slots 57 in the illustrated example, a pair of the slots 57 extending in directions substantially orthogonal to each other are concentrically arranged so that a radial in-line slot antenna is configured. Since the scanning antenna 1000 includes slots that are substantially orthogonal to each other, the scanning antenna 1000 can transmit and/or receive circularly polarized waves.

A plurality of terminal sections IT of the slot electrode 55 are provided in the non-transmission and/or reception region R2. The terminal sections IT are electrically connected to the transfer terminal sections PT (FIG. 2A) of the TFT substrate 101. In this example, the terminal sections IT are disposed within the seal region Rs and are electrically connected to corresponding transfer terminal sections PT using a sealing member containing conductive particles.

In addition, the power feed pin 72 is disposed on a back face side of the slot substrate 201 in the first non-transmission and/or reception region R2*a*. The power feed pin 72 allows microwaves to be inserted into the waveguide 301 constituted by the slot electrode 55, the reflective conductive plate 65, and the dielectric substrate 51. The power feed pin 72 is connected to a power feed device 70. Power feeding is performed from the center of the concentric circle in which the slots 57 are arranged. The power feed method may be either a direct coupling power feed method or an electromagnetic coupling method, and a known power feed structure can be utilized.

FIGS. 2A and 2B illustrate an example in which the seal region Rs is provided surrounding a relatively narrow region including the transmission and/or reception region R1, but the arrangement of the seal region Rs is not limited thereto. In particular, the seal region Rs provided outside the transmission and/or reception region R1 may be provided at or near the side of the dielectric substrate 1 and/or the dielectric substrate 51, for example, so as to maintain a certain distance or more from the transmission and/or reception region R1. For example, in a liquid crystal panel (e.g., a liquid crystal panel 100A illustrated in FIG. 3A) included in a scanning antenna according to the present embodiment to be described later, a region surrounded by a seal portion includes the transmission and/or reception region R1 and a portion of the non-transmission and/or reception region R2. Of course, the terminal section and the driving circuit, for example, that are provided in the non-transmission and/or reception region R2 may be formed outside the seal region Rs (that is, the side where the liquid crystal layer is not present). In general, the portion of the TFT substrate 101 including a terminal section and a drive circuit (e.g., the gate driver GD, the source driver SD, the source terminal section ST, and the gate terminal section GT) is exposed without overlapping the slot substrate 201. Note that in the drawings, the end of the slot substrate 201 and the end of the TFT substrate 101 may be illustrated without distinction for simplicity. By forming the seal region Rs at a position separated from the transmission and/or reception region R1 by a certain distance or more, it is possible to prevent the antenna characteristics from deteriorating due to the influence of impurities (in particular, ionic impurities) contained in the sealing member (in particular, a curable resin).

Reduction in Antenna Performance Due to Temperature Change

As described above, the scanning antenna controls the voltage applied to each liquid crystal layer of each antenna unit to vary the effective dielectric constant $M(\varepsilon_M)$ of the liquid crystal layer in each antenna unit and thereby form a two-dimensional pattern of antenna units having different electrostatic capacitances. However, the electrostatic capacitance values of the antenna units may vary. For example, the volume of liquid crystal material may change depending on the environment temperature of the scanning antenna, and therefore the electrostatic capacitance value of the liquid crystal capacitance may change. As a result, the phase difference given by the liquid crystal layer of the antenna unit to the microwave deviates from a predetermined value. In a case where the phase difference deviates from a predetermined value, the antenna characteristics are deteriorated. This deterioration of the antenna characteristics can be evaluated as a shift in the resonance frequency, for example. In reality, because the scanning antenna is designed to, for example, maximize gain at a predetermined resonance frequency, a reduction in antenna characteristics due to a shift in the resonance frequency appears as a change in gain, for example. Alternatively, in a case where the direction in which the gain of the scanning antenna is maximized deviates from the desired direction, the communication satellite cannot be accurately tracked, for example.

The liquid crystal layer is encapsulated in a space formed by the TFT substrate, the slot substrate, and the seal portion. In other words, the space formed by the TFT substrate, the slot substrate, and the seal portion is filled with a liquid crystal material. As the temperature of the scanning antenna increases, each constituent element of the scanning antenna thermally expands. When the volume of the liquid crystal layer increases, the thickness of the liquid crystal layer forming the liquid crystal capacitance increases, and the electrostatic capacitance value of the liquid crystal capacitance decreases. Particularly influencing antenna performance is a thickness dLC of the liquid crystal layer between the patch electrode and the slot electrode (see FIG. 1). The thickness dLC of the liquid crystal layer between the patch electrode and the slot electrode may change the electrostatic capacitance value of the liquid crystal capacitance of each antenna unit.

With the scanning antenna according to embodiments of the disclosure, even if the volume of the liquid crystal material constituting the liquid crystal layer increases, changes in the thickness of the liquid crystal layer between the patch electrode and the slot electrode is suppressed. Thus, reduction in antenna performance is suppressed.

First Embodiment

Figure 3A:
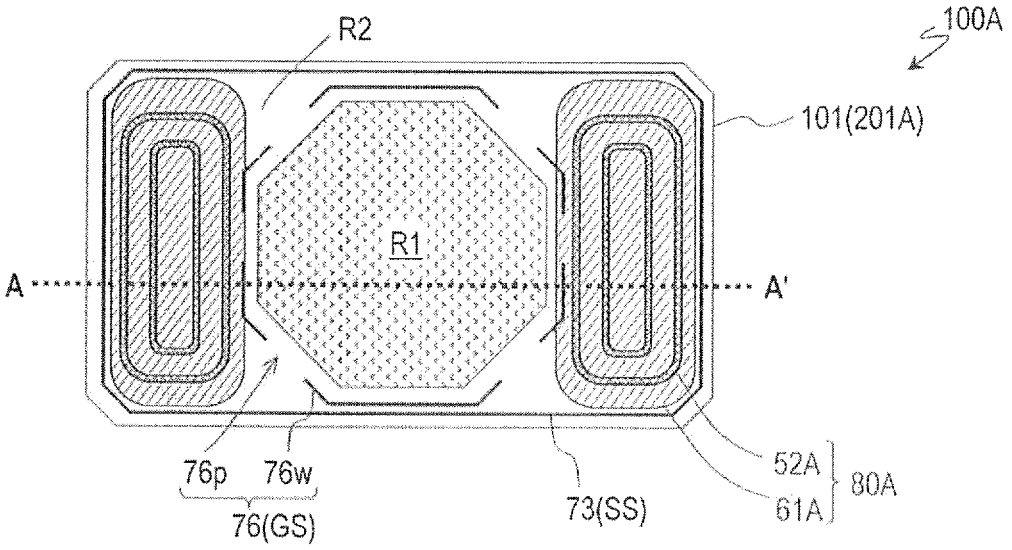
FIG. 3A is a plan view schematically illustrating a liquid crystal panel 100A included in a liquid crystal device (scanning antenna) according to a first embodiment of the disclosure.
Figure 3B:
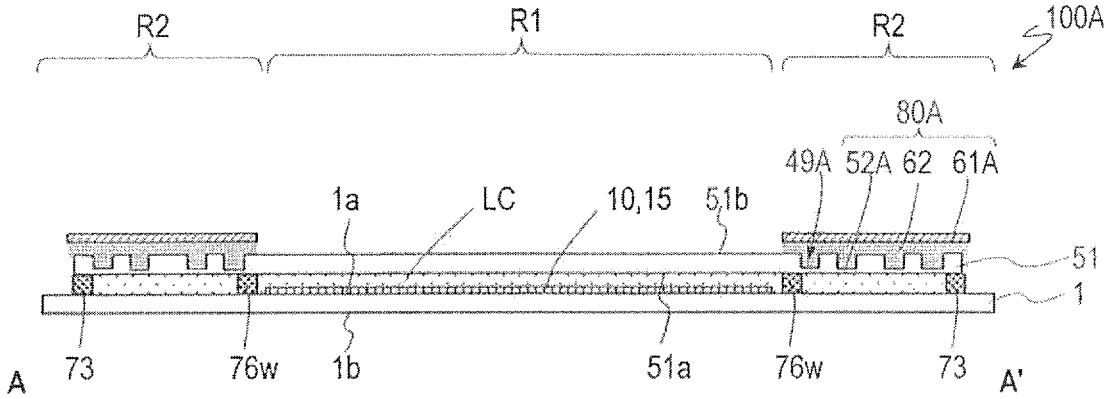
FIG. 3B is a cross-sectional view schematically illustrating the liquid crystal panel 100A.
Figure 3C:
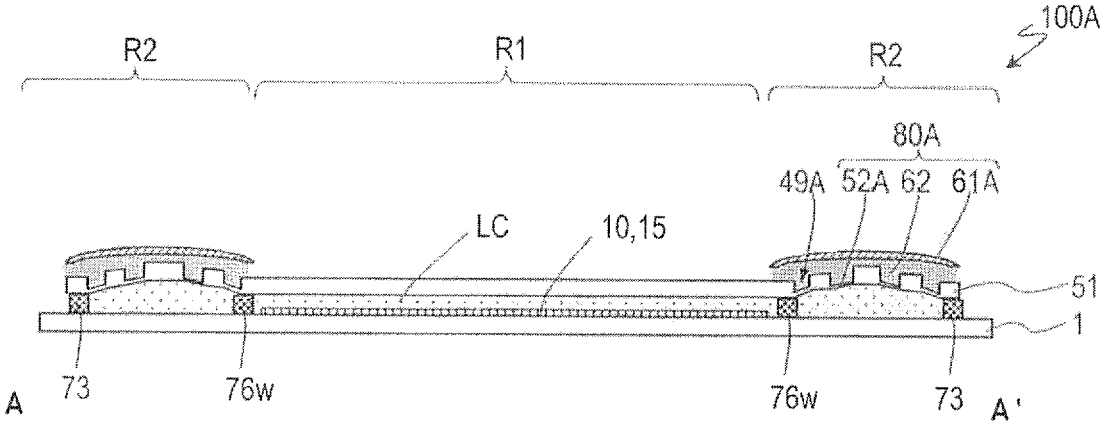
FIG. 3C is a cross-sectional view schematically illustrating the liquid crystal panel 100A.

Now, a scanning antenna according to a first embodiment of the disclosure will be described with reference to FIGS. 3A, 3B, and 3C. Note that, FIGS. 3A, 3B, and 3C illustrate the structure of the liquid crystal panel included in the scanning antenna, and the dielectric layer (air layer) 54 and the reflective conductive plate 65 in the scanning antenna 1000 in FIG. 1 are not illustrated. The liquid crystal panel includes: a TFT substrate; a slot substrate; a liquid crystal layer provided therebetween; and a seal portion surrounding the liquid crystal layer.

FIG. 3A is a plan view schematically illustrating a liquid crystal panel 100A included in the scanning antenna according to the first embodiment of the disclosure. FIGS. 3B and 3C are cross-sectional views schematically illustrating the liquid crystal panel 100A. FIGS. 3B and 3C illustrate the cross section taken along the line A-A' in FIG. 3A. FIG. 3C illustrates the liquid crystal panel 100A at an environmental temperature higher than that in FIG. 3B, and FIG. 3B illustrates the liquid crystal panel 100A at, for example, room temperature. Common reference numerals may be assigned to constituent elements common to the scanning antenna 1000, and descriptions thereof may be omitted.

As illustrated in FIGS. 3A and 3B, the liquid crystal panel 100A includes: the TFT substrate 101; a slot substrate 201A; the liquid crystal layer LC provided between the TFT substrate 101 and the slot substrate 201A and in the entire transmission and/or reception region R1 and in a portion of the non-transmission and/or reception region R2; a sealing seal portion SS surrounding the liquid crystal layer LC and configured to define the maximum value of the area of the liquid crystal layer LC when viewed from the normal direction of the first dielectric substrate 1 or the second dielectric substrate 51; and a cell gap control seal portion GS configured to define the minimum value of the thickness of the liquid crystal layer LC in the transmission and/or reception region R1. The liquid crystal panel 100A further includes a buffer portion 80A that is in contact with the liquid crystal layer LC in the non-transmission and/or reception region R2 and is more likely to deform due to external force than the first dielectric substrate 1 and the second dielectric substrate 51 in the transmission and/or reception region R1. The buffer portion BOA includes a sheet 61A and a joining section 62 that joins the sheet 61A and the second dielectric substrate 51. The sheet 61A is more likely to deform due to external force than the first dielectric substrate 1 and the second dielectric substrate 51 in the transmission and/or reception region R1.

In this example, as illustrated in FIGS. 3A and 3B, the second dielectric substrate 51 includes a thin portion 52A in the non-transmission and/or reception region R2. At the thin portion 52A, the second dielectric substrate 51 has a thickness smaller than in the transmission and/or reception region R1. The thin portion 52A refers to a region in which the thickness of the second dielectric substrate 51 is partially small and is defined by a recessed portion 49A formed in the main surface 51*b* (second main surface 51*b*) further from the liquid crystal layer LC of the second dielectric substrate 51. The buffer portion 80A includes the thin portion 52A of the second dielectric substrate 51, the sheet 61A disposed on a side opposite to the liquid crystal layer LC of the second dielectric substrate 51, and an adhesive layer 62 as the joining section 62. In this embodiment, the sheet 61A is fixed on the second main surface 51*b* of the second dielectric substrate 51 with the adhesive layer 62 between the second dielectric substrate 51 and the sheet 61A. The thin portion 52A of the second dielectric substrate 51 has a thickness smaller than that of the second dielectric substrate 51 in the transmission and/or reception region R1 and thus is more likely to deform than the second dielectric substrate 51 in the transmission and/or reception region R1. The sheet 61A is also more likely to deform than the first dielectric substrate 1 and the second dielectric substrate 51 in the transmission and/or reception region R1.

As illustrated in FIG. 3C, when the liquid crystal material constituting the liquid crystal layer LC expands (that is, the volume of liquid crystal material increases), the buffer portion 80A deforms more greatly than the first dielectric substrate 1 and the second dielectric substrate 51 in the transmission and/or reception region R1 and thus acts to suppress changes in the thickness of the liquid crystal layer LC in the transmission and/or reception region R1. Through suppressing changes in the thickness of the liquid crystal layer LC between the patch electrode 15 and the slot electrode 55 in the scanning antenna that uses the liquid crystal panel 100A, decrease in antenna performance can also be suppressed.

The sheet 61A is disposed so as to overlap the entire thin portion 52A when viewed from the normal direction of the second dielectric substrate 51. When viewed from the normal direction of the second dielectric substrate 51, the sheet 61A is preferably disposed so as to overlap at least a portion of the thin portion 52A and is further preferably disposed so as to overlap the entire thin portion 52A. For example, the sheet 61A preferably has an area greater than that of the thin portion 52A when viewed from the normal direction of the second dielectric substrate 51 and, at least, is disposed such that distance from an end of the thin portion 52A covers a region of approximately several millimeters.

As described above, the slot electrode 55 or the like is formed on the main surface 51*a* (first main surface 51*a*) that is closer to the liquid crystal layer LC of the second dielectric substrate 51. In FIGS. 3A, 3B, and 3C, the slot electrode 55 is not illustrated for simplicity.

FIG. 3C illustrates a case where environmental temperature increases and the volume of the liquid crystal material constituting the liquid crystal layer increases. However, the scanning antenna including the liquid crystal panel 100A is also effective in a case where the environmental temperature decreases and the volume of the liquid crystal material constituting the liquid crystal layer decreases. In other words, when the liquid crystal material constituting the liquid crystal layer LC is heat shrunk (that is, the volume of the liquid crystal material decreases), the buffer portion 80A deforms more greatly than the first dielectric substrate 1 and the second dielectric substrate 51 in the transmission and/or reception region R1 and thus acts to suppress changes in the thickness of the liquid crystal layer LC in the transmission and/or reception region R1. Through suppressing changes in the thickness of the liquid crystal layer LC between the patch electrode 15 and the slot electrode 55, reduction in antenna performance is suppressed. Note that the density and arrangement of spacers provided in the non-transmission and/or reception region R2 (including the buffer portion 80A) is preferably designed such that the liquid crystal layer LC in contact with the buffer portion 80A is not prevented from becoming thinner. For example, the region including the buffer portion 80A is preferably not provided with columnar spacers that define the thickness of the liquid crystal layer LC. Using spacers or structures having a height lower than that of columnar spacers that define the thickness of the liquid crystal layer LC may not be problematic even if the spacers or structures are provided in the region including the buffer portion 80A. Even if the columnar spacers are provided in the region including the buffer portion 80A, as long as the density of the columnar spacers that define the thickness of the liquid crystal layer LC is small, the function of the buffer portion is unlikely to be affected.

It is conceivable that partially reducing the thickness of the dielectric substrate by forming the recessed portion in the surface of the dielectric substrate causes problems (e.g., breakage or cracking during transport and other times) due to a decrease in the mechanical strength of the dielectric substrate. Likewise, it is conceivable that setting the thickness of the thin portion such that the mechanical strength of the dielectric substrate can be sufficiently ensured may make it difficult to sufficiently suppress changes in the thickness of the liquid crystal layer LC in the transmission and/or reception region R1. However, in the present embodiment, the buffer portion 80A includes the sheet 61A, and the sheet 61A reinforces the mechanical strength of the thin portion 52A of the dielectric substrate 51. By providing the buffer portion 80A, the scanning antenna according to the present embodiment can sufficiently suppress changes in the thickness of the liquid crystal layer LC in the transmission and/or reception region R1, while mitigating reduction in the mechanical strength of the dielectric substrates. The mechanical strength of the dielectric substrate is set in consideration of vibrations and shocks that the scanning antenna may be subject to, based on usage. In particular, applying the adhesive layer 62 such that the thin portion 52A entirely overlaps the adhesive layer 62 when viewed from the normal direction of the dielectric substrate 51 can achieve the following effects: cracking in the dielectric substrate 51 is suppressed, in a case where the dielectric substrate 51 cracks, cracked pieces can be prevented from diffusing into the liquid crystal layer LC, and, in a case where fissures occur in the dielectric substrate 51, the fissures can be prevented from developing. Thus, the above-described problems are prevented.

A film or sheet that deforms more easily than the dielectric substrates (e.g. glass substrates) 1 and 51 can be used as the sheet 61A. The material of the sheet 61A is not particularly limited, and a known film or sheet can be used. The sheet 61A includes, for example, a polymer film. Examples of the polymer film 61A include a polyester film made of polyethylene terephthalate, polyethylene naphthalate or the like, and a film made of a super engineering plastic such as polyphenylene sulfone and polyimide or polyamide. A silicone rubber sheet may be used as the polymer film 61A. Alternatively, the sheet 61A may be a thin metal film. When the sheet 61A is a thin metal film, the thickness of the sheet 61A is, for example, between 0.002 mm (2 μm) and 0.2 mm. When the thickness of the sheet 61A is less than or equal to 0.2 mm, which is thinner than a glass substrate, the above-described effects can be expected. In a case where the sheet 61A is, for example, stainless steel, the thickness of the sheet 61A is more preferably less than or equal to 0.05 mm from the perspective of mass manufacture, strength, and ease of deformation of the sheet 61A. In a case where the sheet 61A is a polyimide film, the thickness of the sheet 61A is, for example, between 0.005 mm and 0.2 mm. For example. A polyimide film preferably has a thickness in the range described above in order to improve strength of the sheet and because commercially available sheets typically have a thickness between approximately 0.01 mm and 0.1 mm. In a case where the sheet 61A is a silicone rubber sheet, the thickness of the sheet 61A is, for example, between 0.05 mm and 3 mm. A silicone rubber sheet tends to have a higher elastic modulus than a polyimide film, and thus a material that is thicker than a polyimide film can be used. The typical thickness of a commercially available silicone rubber sheet is more than or equal to 1 mm.

The thickness of the thin portion 52A of the second dielectric substrate 51 is, for example, equal to or less than 50% the thickness of the second dielectric substrate 51 in the transmission and/or reception region R1. The thickness of the thin portion 52A of the second dielectric substrate 51 is, for example, between approximately 0.05 mm and 0.2 mm. The thickness of the second dielectric substrate 51 in the transmission and/or reception region R1 is, for example, equal to or less than 0.5 mm. From the perspective of easily deforming the dielectric substrate at the buffer portion, the thickness of the thin portion of the dielectric substrate is preferably small.

The thickness of the thin portion 52A of the second dielectric substrate 51 can be, for example, equal to or less than 0.1 mm. In a case where the buffer portion 80A does not include the sheet 61A (that is, in a case where the buffer portion only has a thin portion where the thickness of the dielectric substrate is partially smaller than in the transmission and/or reception region), in a case where a thickness of the thin portion of the dielectric substrate is 0.1 mm or less, the dielectric substrate may crack due to deformation associated with changes in the volume of the liquid crystal material. When the dielectric substrate cracks, the liquid crystal material leaks out and the dielectric substrate cannot be used as a scanning antenna. In contrast, in the embodiments of the disclosure, the buffer portion 80A includes the sheet 61A, and therefore even if the dielectric substrate cracks at the buffer portion, the dielectric substrate can be used as a scanning antenna. The thickness of the thin portion of the dielectric substrate may be reduced assuming that the dielectric substrate cracks while being used as a scanning antenna. In this way, the thickness of the thin portion 52A of the second dielectric substrate 51 can be reduced because the buffer portion 80A includes the sheet 61A.

As illustrated in FIGS. 3A and 3B, in the liquid crystal panel 100A, a seal portion 73 is formed with the sealing member provided between the first dielectric substrate 1 and the second dielectric substrate 51. In the present embodiment, the seal portion 73 constitutes the sealing seal portion SS. In the present specification, a member that surrounds the liquid crystal layer LC and is configured to define the maximum value of the area of the liquid crystal layer LC when viewed from the normal direction of the first dielectric substrate 1 or the second dielectric substrate 51 is referred to as a "sealing seal portion". The sealing seal portion is at least partially formed of the sealing member that bonds the TFT substrate and the slot substrate. In the present specification, a member configured to define the minimum value of the thickness of the liquid crystal layer LC in the transmission and/or reception region R1 is referred to as a "cell gap control seal portion". As illustrated in FIG. 3A, the liquid crystal panel 100A includes an inner structure 76 that serves as the cell gap control seal portion GS. The inner structure 76 is provided in a region surrounded by the seal portion 73 (sealing seal portion SS) in the non-transmission and/or reception region R2. The inner structure 76 is disposed in the non-transmission and/or reception region R2 in the vicinity of the transmission and/or reception region R1. The inner structure 76 is formed using, for example, a resin containing conductive particles as the sealing member.

Figure 14A:
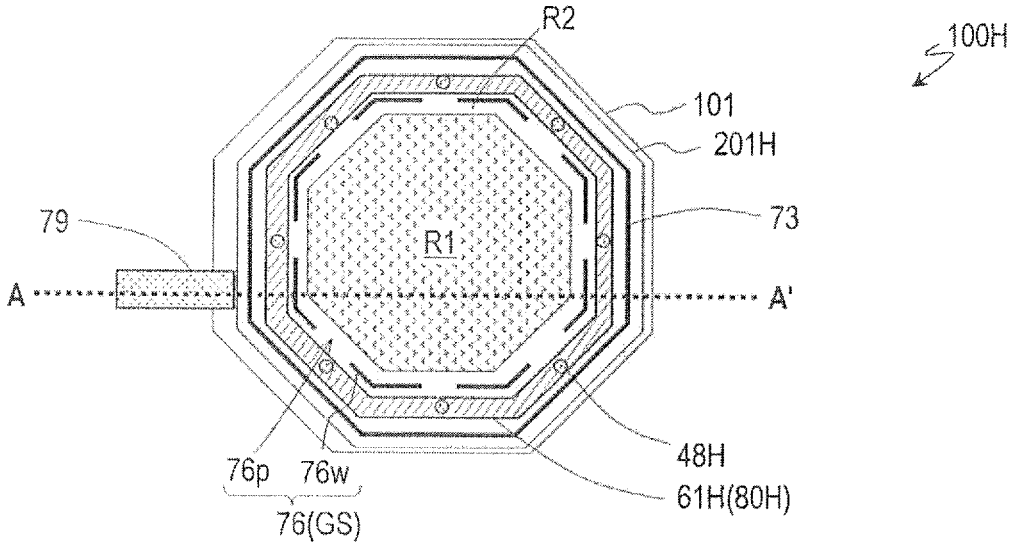
FIG. 14A is a plan view schematically illustrating a liquid crystal panel 100H according to yet another modification example of the second embodiment.

The sealing seal portion is formed of, for example, the seal portion 73 in the liquid crystal panel 100A. However, the sealing seal portion is not limited to this example, as exemplified in the following embodiment. The sealing seal portion is at least partially formed of the sealing member and may further include other members. For example, as illustrated in FIGS. 14A and 14C to be described later and in FIGS. 15A and 15C, when the buffer portion includes a sheet that covers a through-hole formed in the first or second dielectric substrate and the joining section that joins the sheet and the first or second dielectric substrate, the liquid crystal material is allowed to move not only between the first and second dielectric substrates, but also outward of the first or second dielectric substrate through the through-hole. In such a case, the sealing seal portion is composed of: the seal portion formed of the sealing member provided between the first and second dielectric substrates; and the joining section.

When at least a portion of the sealing seal portion deforms easily due to external force, the area of the liquid crystal layer LC when viewed from the normal direction of the first or second dielectric substrate may vary depending on an increase or decrease in the volume of the liquid crystal material, and the sealing seal portion defines the maximum value of the area of the liquid crystal layer LC.

The cell gap control seal portion refers to a portion that is formed of the sealing member and does not follow the decrease in the volume of the liquid crystal material constituting the liquid crystal layer LC. The minimum value of the thickness of the liquid crystal layer LC is defined by the thickness of the cell gap control seal portion (thickness of the first dielectric substrate 1 or the second dielectric substrate 51 in the normal direction). When the cell gap control seal portion is provided, even when the volume of liquid crystal material decreases, since the cell gap control seal portion does not follow the decrease in the volume of the liquid crystal material, the thickness of the liquid crystal layer LC at or near the cell gap control seal portion does not become thinner than the thickness defined by the cell gap control seal portion. On the other hand, when the volume of the liquid crystal material increases, the thickness of the liquid crystal layer LC may increase due to, for example, the sealing member constituting the cell gap control seal portion thermally expanding.

The liquid crystal panel 100A typically further includes a plurality of columnar spacers (not illustrated) provided in the transmission and/or reception region R1 and that define the minimum value of the thickness of the liquid crystal layer LC in the transmission and/or reception region R1. The cell gap control seal portion GS can define the minimum value of the thickness of the liquid crystal layer LC in the transmission and/or reception region R1 along with the plurality of columnar spacers. The columnar spacers are typically formed of a photosensitive resin. The elastic modulus, dimensions, arrangement density and the like of the columnar spacers are set to define the thickness of the liquid crystal layer. Performance of the scanning antenna is dependent on the thickness of the liquid crystal layer in the transmission and/or reception region R1. Accordingly, among the liquid crystal layers included in the scanning antenna, the thickness of the liquid crystal layer in the transmission and/or reception region R1 needs to be precisely controlled. Typically, the liquid crystal layer in the transmission and/or reception region R1 has the smallest value among the liquid crystal layers between the first and second dielectric substrates included in the scanning antenna. The coefficient of thermal expansion of each columnar spacer is smaller than the coefficient of thermal expansion of the liquid crystal material. Thus, even when the volume of the liquid crystal material shrinks due to decrease in temperature, the columnar spacers act to maintain the cell gap. On the other hand, unlike the sealing member, the columnar spacers do not function as an adhesive and therefore cannot suppress an increase in the cell gap caused by thermal expansion of the liquid crystal material. In this sense, the columnar spacers define the minimum value of the thickness of the liquid crystal layer. Of course, the columnar spacers may also heat shrink slightly compared to the liquid crystal material, but this heat shrinkage is approximately negligible.

A granular spacer is combined with the sealing member that forms the cell gap control seal portion, and the thickness (minimum value) of the liquid crystal layer in the transmission and/or reception region R1 is defined by the granular spacer together with the columnar spacers disposed in the transmission and/or reception region R1. For example, as in the example illustrated in FIG. 3A, when the seal portion (seal portion 73) that defines the outer periphery of the liquid crystal layer is provided separately to the cell gap control seal portion, the granular spacer included in the sealing member that forms an outer peripheral seal portion may be larger than the granular spacer in the cell gap control seal portion. The thickness of the seal portion 73 (thickness of the first dielectric substrate 1 or the second dielectric substrate 51 in the normal direction) is determined by the particle size of the granular spacer included in the sealing member that forms the outer peripheral seal portion. In this case, the seal portion 73 (here, the sealing seal portion SS) defines the minimum value of the thickness of the liquid crystal layer LC in the non-transmission and/or reception region R2. The minimum value of the thickness of the liquid crystal layer LC in the non-transmission and/or reception region R2 defined by the seal portion 73 (here, the sealing seal portion SS) may be substantially equal to the minimum value of the thickness of the liquid crystal layer LC in the transmission and/or reception region R1 defined by the inner structure 76 (here, the cell gap control seal portion GS). In other words, the inner structure 76 and the seal portion 73 may have the same thickness.

Note that the transfer section for electrically connecting the slot electrode 55 and the transfer terminal section PT on the TFT substrate may be provided within the cell gap control seal portion or the outer peripheral seal portion, or may be provided independently of the cell gap control seal portion and the outer peripheral seal portion. The transfer section can be formed of a sealing member containing electrically conductive particles, for example.

The inner structure 76 is formed of the same material as the seal portion 73, for example. The inner structure 76 may be prepared using the same process as the seal portion 73. For example, the inner structure 76 is obtained as follows. A pattern having openings formed around the transmission and/or reception region R1 is drawn with the sealing member. Then, the sealing member is cured by being heated at a predetermined temperature for a predetermined amount of time. Alternatively, the inner structure 76 may be prepared by patterning a photosensitive resin film using photolithography.

Note that the inner structure 76 can be omitted. In this case, the sealing seal portion need only be configured to include the cell gap control seal portion, for example. In other words, it is sufficient that at least a portion of the seal portion 73 be configured to define the minimum value of the thickness of the liquid crystal layer LC in the transmission and/or reception region R1.

The inner structure 76 need only be provided such that the liquid crystal material constituting the liquid crystal layer LC can move in and out of the inner structure 76. In this example, the inner structure 76 includes: a plurality of wall parts 76*w* discretely disposed around the transmission and/or reception region R1; and openings 76*p* formed between adjacent walls 76*w*. Ease of movement can be adjusted through adjusting the size of the openings 76*p* as required.

The sealing seal portion SS is not limited to the example described above. For example, at least a portion of the sealing seal portion (e.g., at least a portion of the seal portion 73) may be made of a material (for example, a rubber-based resin or the like) that deforms more easily due to external force than the cell gap control seal portion GS. At least a portion of such a sealing seal portion functions as a buffer portion because the sealing seal portion easily deforms according to changes in the volume of the liquid crystal material. In this case, it is thought that changes in the thickness of the liquid crystal layer LC in the transmission and/or reception region R1 can be suppressed more effectively.

Herein, there has been described a case where the sheet 61A deforms more easily due to external force than the first dielectric substrate 1 and the second dielectric substrate 51 in the transmission and/or reception region R1. However, the buffer portion included in the scanning antenna according to the embodiments of the disclosure is not limited to the illustrated example. For example, as in the examples illustrated in FIGS. 11A and 11B to be described below, when at least a portion of the joining section that joins the sheet and the first or second dielectric substrate constitutes the sealing seal portion, at least a portion of the joining section may deform more easily due to external force than the cell gap control seal portion. Of course, both the sheet and the joining section may be configured to easily deform due to external force. Details will be described below.

Manufacturing Method of Liquid Crystal Panel 100A

The slot substrate 201A is manufactured as follows. First, the dielectric substrate 51 having the first main surface and the second main surface is prepared. After a glass substrate is prepared, for example, the dielectric substrate 51 may be obtained by performing a step of thinning (e.g., thinning the entire glass substrate) the prepared glass substrate (e.g., a slimming step). As an example, a glass substrate having two opposing main surfaces (first and second main surfaces) is prepared, and only one of the main surfaces of the prepared glass substrate (second main surface) is slimmed. A protecting member is provided to expose only the main surface to be slimmed among the surfaces of the glass substrate and cover the rest of the surface. The protecting member (e.g., protective tape) is formed of, for example, a resin having etching resistance. The protecting member is immersed in an etchant for glass (e.g., aqueous hydrofluoric acid). A commercially available etchant for glass can be used as appropriate. The thickness of the dielectric substrate 51 of the slot substrate 201A is preferably smaller than the thickness of the dielectric substrate 1 of the TFT substrate 101 from the perspective of antenna performance. A liquid crystal panel including the prepared dielectric substrates 1 and 51 is obtained by, for example, preparing a glass substrate in which the dielectric substrates 1 and 51 have the same thickness, and performing a step (slimming step) of thinning only the glass substrate to be the dielectric substrate 51. Generally, an LCD manufacturing line is configured to manufacture a TFT substrate and an opposing substrate using a common glass substrate. Therefore, the liquid crystal panel can be manufactured using the method described above using only an LCD manufacturing line. Note that a step of thinning the entire dielectric substrate of the slot substrate may be performed after the slot substrate and the TFT substrate have been bonded using a process to be described below or may be performed after the liquid crystal layer LC is formed between the slot substrate and the TFT substrate using a process to be described below. In this case, the shape of the protecting member need only be appropriately changed such that the protecting member protects a portion other than the thinned portion (e.g., the TFT substrate).

The recessed portion 49A is then formed by partially etching (slimming) one main surface (here, the second main surface) of the dielectric substrate 51. For example, the dielectric substrate 51 is immersed in an etchant for glass while the protective member, exposing only the portion of the second main surface of the dielectric substrate 51 to be slimmed, covers the surface of the dielectric substrate 51. The position at which the recessed portion 49A is formed can be designed to tolerate an error of approximately several millimeters. Thus, the recessed portion 49A can be formed using such a method at low cost. Then, the protecting member is removed and the sheet 61A is applied to the second main surface of the dielectric substrate 51, covering the recessed portion 49A on the second main surface of the dielectric substrate 51. The sheet 61A is fixed to the dielectric substrate 51 via the adhesive layer 62.

Thereafter, a constituent element such as the slot electrode 55 is formed on the first main surface of the dielectric substrate 51 using a known method. For example, an insulating layer, the slot electrode 55, an insulating layer covering the slot electrode 55, and a transparent conductive layer are formed on the first main surface of the dielectric substrate 51 in this order.

Note that the second main surface of the dielectric substrate 51 may be partially etched (slimmed) after the constituent element such as the slot electrode 55 is formed on the first main surface of the dielectric substrate 51. Alternatively, the second main surface of the dielectric substrate 51 can be partially etched (slimmed) after the slot substrate and the TFT substrate are bonded using a process to be described below, or the second main surface of the dielectric substrate 51 can also be partially etched (slimmed) after the liquid crystal layer LC is formed between the slot substrate and the TFT substrate using a process to be described below. However, performing the step of partially etching (slimming) the second main surface of the dielectric substrate 51 directly after the step of thinning the entire dielectric substrate described above is preferable from the perspective of manufacturing costs. For example, the same etching bath can be used. From the perspective of manufacturing costs, it is even more preferable that the main surface to be slimmed in the step of thinning the entire dielectric substrate 51 is the same as the main surface to be partially slimmed. For example, a protecting member that exposes the entire second main surface of the dielectric substrate 51 used in the step of slimming the entire second main surface of the dielectric substrate 51 can be used in the next step of partially slimming the second main surface of the dielectric substrate 51 in conjunction with a protecting member that partially exposes the second main surface.

The liquid crystal panel 100A is manufactured as follows using the slot substrate 201A manufactured as described above and the TFT substrate 101 prepared using a known method.

First, the seal portion 73 is formed as follows. A sealing member is used to draw a pattern serving as the seal portion 73 on one of the slot substrate 201A and the TFT substrate 101 using, for example, a dispenser. In a case where the liquid crystal layer LC is formed using vacuum injection, a pattern including an opening at a portion serving as an injection port (not illustrated) is drawn with the sealing member.

In a case where one drop filling is used, no injection port is formed. In addition, a pattern serving as the inner structure 76 is drawn on the one substrate with the sealing member. Furthermore, a sealing resin containing conductive particles is applied to a terminal section of the one substrate (the transfer terminal section PT of the TFT substrate 101 or the terminal section IT of the slot substrate 201A). Instead of using a dispenser to draw with the sealing member, the sealing member may be applied in a predetermined pattern by screen printing, for example. Then, the sealing member is cured by overlaying the other substrate and heating for a predetermined amount of time at a predetermined temperature and a predetermined pressure. A granular spacer (e.g., resin beads) for controlling the cell gap is mixed into the sealing member, and the slot substrate 201A and the TFT substrate 101 are bonded and fixed to each other while maintaining a gap in which the liquid crystal layer LC is formed therebetween. Accordingly, the seal portion 73 (or a main seal portion that defines the injection port) is formed.

Next, the liquid crystal layer LC is formed. For example, a liquid crystal material is injected through the injection port using vacuum injection. Then, for example, a thermosetting-type encapsulant is applied to close the injection port, and the encapsulant is heated at a predetermined temperature for a predetermined amount of time to cure the encapsulant and form an end seal portion (not illustrated). When vacuum injection is used, the entire seal portion 73 surrounding the liquid crystal layer LC is formed with the main seal portion and the end seal portion in this way. Alternatively, the liquid crystal layer LC may be formed using one drop filling. When employing one drop filling, the main seal portion is formed to surround the liquid crystal layer LC, and thus the end seal portion and the injection port are not formed.

Thus, the liquid crystal panel 100A is manufactured.

Note that when a plurality of TFT substrates are prepared from one mother glass substrate and a plurality of slot substrates are prepared from a single mother glass substrate, after the mother glass substrates are bonded together to form the seal portion, portions corresponding to each liquid crystal panel need only be cut out by dicing or laser processing, for example, before forming the liquid crystal layers.

Modification Example

As described above, in the present embodiment, a thin portion at which the thickness of the dielectric substrate is partially thin is provided as the buffer portion to allow the dielectric substrate to crack while operating as a scanning antenna. In consideration of the possibility that the dielectric substrate (e.g., glass substrate) cracks at the buffer portion, the dielectric substrate may have a structure in which broken pieces of the dielectric substrate is less likely to reach the liquid crystal layer LC in the transmission and/or reception region R1, even if broken pieces of the dielectric substrate occur in the liquid crystal layer LC in contact with the buffer portion. For example, when the opening of the inner structure 76 is reduced, it is possible to suppress broken pieces of the dielectric substrate from reaching the liquid crystal layer LC in the transmission and/or reception region R1. Alternatively, by providing an inner structure having a labyrinth structure when viewed from the normal direction of the dielectric substrate 51, it is possible to suppress broken pieces of the dielectric substrate from reaching the liquid crystal layer LC in the transmission and/or reception region R1. Another example of a structure in which debris of the dielectric substrate is less likely to reach the liquid crystal layer LC in the transmission and/or reception region R1 will be described with reference to FIG. 4.

Figure 4:
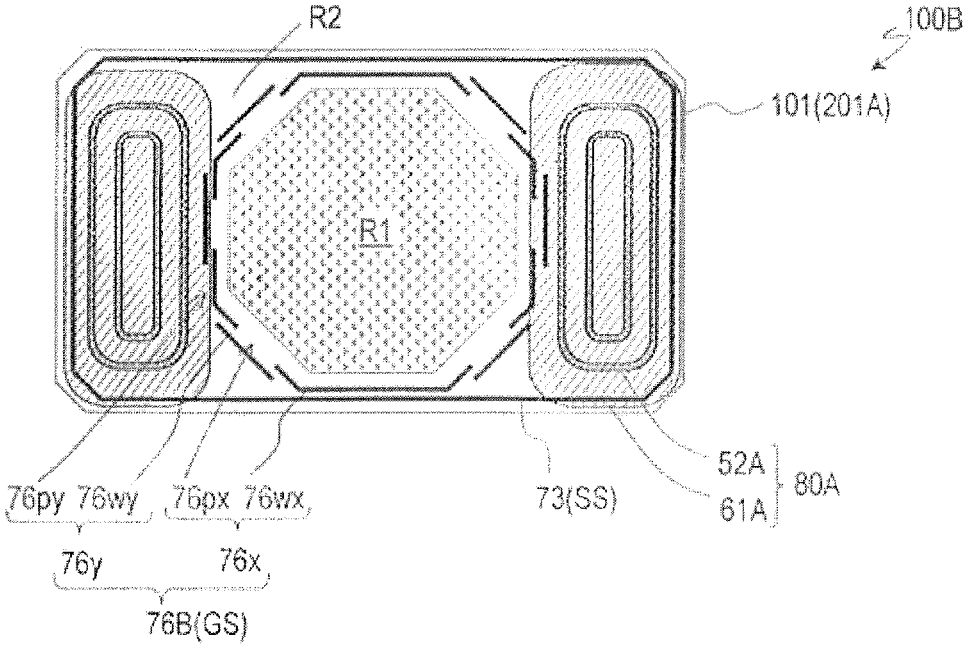
FIG. 4 is a plan view schematically illustrating a liquid crystal panel 100B according to a modification example of the first embodiment.

FIG. 4 illustrates a liquid crystal panel 100B according to a modification example of the present embodiment. FIG. 4 is a plan view schematically illustrating the liquid crystal panel 100B. The liquid crystal panel 100B differs from the liquid crystal panel 100A in terms of the planar shape (that is, the shape when viewed from the normal direction of the dielectric substrate 1 or 51) of an inner structure 76B.

As illustrated in FIG. 4, the inner structure 76B includes a first inner structure 76*x* and a second inner structure 76*y* disposed outside the first inner structure 76*x*. The first inner structure 76*x* includes: a plurality of wall parts 76*wx* discretely disposed around the transmission and/or reception region R1; and openings 76*px* formed between adjacent wall parts 76*wx*. The second inner structure 76*y* includes: a plurality of wall parts 76*wy* discretely disposed around the transmission and/or reception region R1; and openings 76*py* formed between adjacent wall parts 76*wy*. As illustrated in FIG. 4, the openings 76*px* in the first inner structure 76*x* and the openings 76*py* in the second inner structure 76*y* are preferably staggered around the periphery of the transmission and/or reception region R1. With this configuration, it is possible to more effectively suppress broken pieces of the dielectric substrate from reaching the liquid crystal layer LC in the transmission and/or reception region R1.

In the examples illustrated in FIGS. 3A, 3B, and 3C, the recessed portion 49A is formed on the second main surface 51*b* (main surface (front face) further from the liquid crystal layer LC) of the second dielectric substrate 51. The sheet 61A is disposed on the opposite side of the second dielectric substrate 51 from the liquid crystal layer LC. The buffer portion included in the scanning antenna according to the present embodiment is not limited to this example. For example, the buffer portion may have a thin portion defined by a recessed portion formed in the first main surface 51*a* of the second dielectric substrate 51. However, as described above, generally speaking, the recessed portion is preferably formed in the second main surface 51*b* in terms of lowering manufacturing costs because the step of slimming the entire second main surface 51*b* of the second dielectric substrate 51 is performed. When a recessed portion is formed in the first main surface 51*a* of the second dielectric substrate 51, a step of partially slimming the first main surface 51*a* of the second dielectric substrate 51 is performed prior to bonding the slot substrate and the TFT substrate.

Note that when a recessed portion is formed in the first main surface 51*a* of the second dielectric substrate 51, the slot electrode 55 including the slot 57 in the transmission and/or reception region R1 preferably does not extend to the non-transmission and/or reception region R2. For example, the slot electrode 55 preferably does not overlap the recessed portion formed in the non-transmission and/or reception region R2 when viewed from the normal direction of the dielectric substrate 51. However, the slot electrode 55 may extend to the non-transmission and/or reception region R2 and, in this case, the buffer portion deforms more easily due to external force than the first dielectric substrate 1 and the second dielectric substrate 51 in the transmission and/or reception region R1. Thus, the slot electrode 55 can act to suppress changes in the thickness of the liquid crystal layer LC in the transmission and/or reception region R1. When viewed from the normal direction of the dielectric substrate 51, the surface of the slot electrode 55 may reflect the shape of the recessed portion when the slot electrode 55 extends in the non-transmission and/or reception region R2 to a region overlapping the recessed portion formed in the first main surface 51*a* of the dielectric substrate 51.

Alternatively, the buffer portion may include a sheet disposed on the second dielectric substrate 51 closer to the liquid crystal layer LC. When the sheet is disposed closer to the liquid crystal layer LC than the dielectric substrate, the sheet preferably has low reactivity with the liquid crystal material constituting the liquid crystal layer LC. Further, when the sheet is disposed closer to the liquid crystal layer LC than the dielectric substrate, the thickness of the sheet is set in consideration of the thickness of the liquid crystal layer LC. For example, a sheet having a thickness smaller than the desired thickness of the liquid crystal layer LC (e.g., may be equal to or less than 10 μm) is selected. Alternatively, a thin portion that functions as a buffer portion may be provided. The thin portion may be formed by partially thinning the region of the dielectric substrate in which the sheet is provided, in consideration of the thickness of the sheet, and then by further partially thinning the thinned region.

The surface (main surface) of the second dielectric substrate 51 formed with the recessed portion and the positional relationship between the sheet and the second dielectric substrate 51 (the side or the opposite side of the second dielectric substrate 51 from the liquid crystal layer LC) may be independently selected.

Further, the buffer portion included in the scanning antenna according to the embodiments of the disclosure is not limited to including the thin portion defined by the recessed portion formed in a main surface of the second dielectric substrate 51 and the sheet included in the slot substrate 201A. For example, a scanning antenna according to an embodiment of the disclosure may include: a buffer portion that has a thin portion defined by a recessed portion formed in one of the main surfaces of the first dielectric substrate 1; and the sheet included in the TFT substrate 101. A main surface of the first dielectric substrate 1 closer to the liquid crystal layer LC may be referred to as a first main surface 1*a*, and a main surface of the first dielectric substrate 1 further from the liquid crystal layer LC may be referred to as a second main surface 1*b*. The buffer portion included in the scanning antenna according to an embodiment of the disclosure may have a first buffer portion including: a thin portion defined by a recessed portion formed in at least one main surface of the second dielectric substrate 51; and a sheet included in the slot substrate 201 and may have a second buffer portion including: a thin portion defined by a recessed portion formed in at least one main surface of the first dielectric substrate 1; and a sheet included in the TFT substrate 101.

In the example illustrated in FIGS. 3A and 4, the thin portions 52A are formed outlining two rounded corner squares having different sizes when viewed from the normal direction of the second dielectric substrate 51. The planar shape (i.e., the shape when viewed from the normal direction of the dielectric substrate) of the thin portion is not limited to that illustrated.

Figure 5:
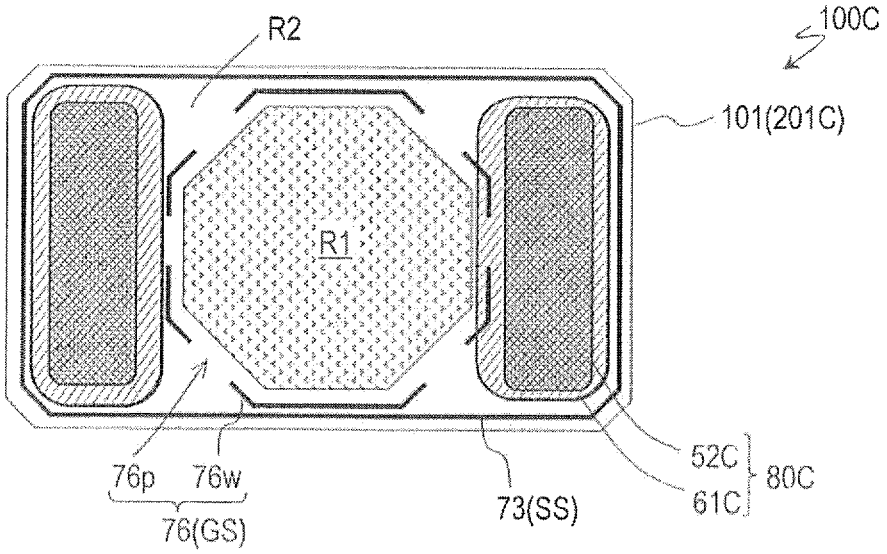
FIG. 5 is a plan view schematically illustrating a liquid crystal panel 100C according to another modification example of the first embodiment.

FIG. 5 illustrates a liquid crystal panel 100C according to another modification example of the present embodiment. FIG. 5 is a plan view schematically illustrating the liquid crystal panel 100C. A buffer portion 80C of the liquid crystal panel 100C differs from the buffer portion 80A of the liquid crystal panel 100A in terms of the planar shape of a thin portion 52C in the second dielectric substrate 51. The planar shape of the thin portion 52C is a rounded corner square shape. The area of the planar shape of the thin portion 52C is greater than the area of the planar shape of the thin portion 52A.

If the thin portion has a large area when viewed from the normal direction of the dielectric substrate, there is a great effect of suppressing the deformation of the first dielectric substrate 1 and the second dielectric substrate 51 in the transmission and/or reception region R1. On the other hand, it is possible to suppress reduction in the mechanical strength of the dielectric substrates when the thin portion has a smaller area when viewed from the normal direction of the dielectric substrate. When the sums of the areas of the thin portions when viewed from the normal direction of the dielectric substrate are the same, when the proportion of the areas of the thin portions viewed from the normal direction of the dielectric substrate is small in a predetermined region, it is easier to suppress reduction in the mechanical strength of the dielectric substrates in the predetermined region. For example, the planar shape of the thin portion is preferably a shape having a pattern formed of relatively narrow lines such as that illustrated in FIG. 3A rather than a shape covering an entire region as illustrated in FIG. 5.

Figure 6A:
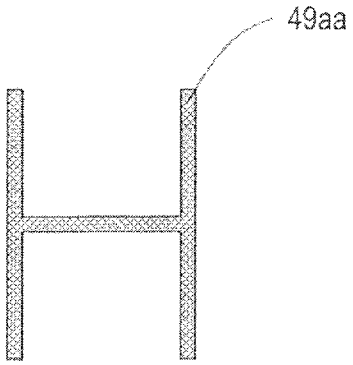
FIG. 6A is a diagram illustrating an exemplary planar shape of a recessed portion.
Figure 6B:
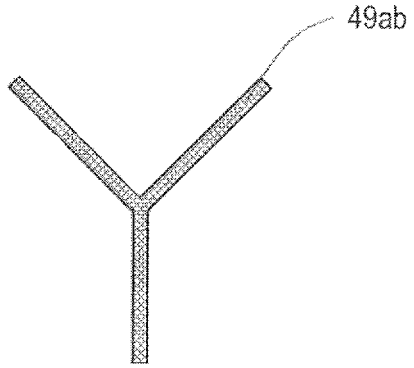
FIG. 6B is a diagram illustrating an exemplary planar shape of a recessed portion.
Figure 6C:
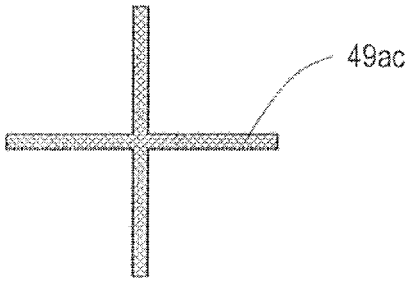
FIG. 6C is a diagram illustrating an exemplary planar shape of a recessed portion.
Figure 6D:
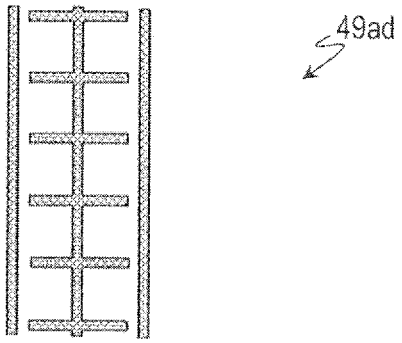
FIG. 6D is a diagram illustrating an exemplary planar shape of a recessed portion.
Figure 6E:
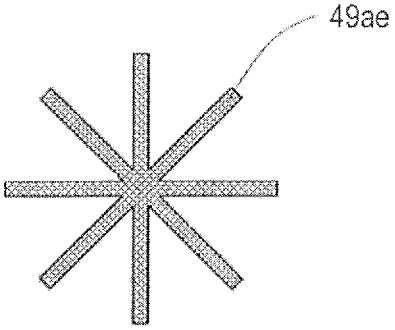
FIG. 6E is a diagram illustrating an exemplary planar shape of a recessed portion.
Figure 6F:
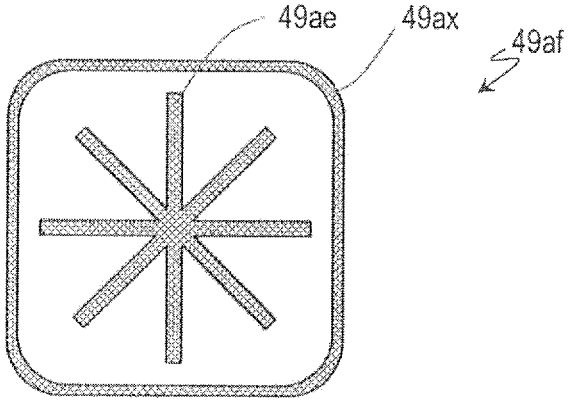
FIG. 6F is a diagram illustrating an exemplary planar shape of a recessed portion.
Figure 6G:
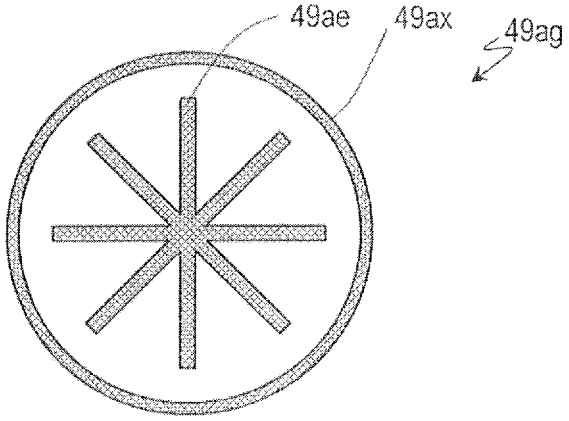
FIG. 6G is a diagram illustrating an exemplary planar shape of a recessed portion.

Other examples of the planar shape of the recessed portion that defines the thin portion are schematically illustrated in FIGS. 6A, 6B, 6C, 6D, 6E, 6F, and 6G. Note that the planar shape of the recessed portion corresponds to the planar shape of the thin portion. A recessed portion 49*aa* illustrated in FIG. 6A has an "H"-shaped planar shape. A recessed portion 49*ab* illustrated in FIG. 6B has a "Y"-shaped planar shape. A recessed portion 49*ac* illustrated in FIG. 6C has a "+" (plus or cross)-shaped planar shape. A recessed portion 49*ad* illustrated in FIG. 6D has a planar shape in which a plurality of vertically or horizontally extending straight lines are combined. A recessed portion 49*ae* illustrated in FIG. 6E has an "*" (asterisk)-shaped planar shape. A recessed portion 49*af* illustrated in FIG. 6F is a combination of the recessed portion 49*ae* having an "*"-shaped planar shape and a recessed portion 49*ax* having a planar shape forming the outline of a rounded corner square. A recessed portion 49*ag* illustrated in FIG. 6G is a combination of the recessed portion 49*ae* having an "*"-shaped planar shape and a recessed portion 49*ay* having a planar shape that forms a circumference.

The planar shape of the recessed portion that defines the thin portion of the buffer portion is not limited to that illustrated. Needless to say, the illustrated planar shapes may be combined. The planar shape of the recessed portion that defines the thin portion of the buffer portion may be, for example, a polygon (e.g., a square), a rounded corner polygon (e.g., a rounded corner square), a circle, or an ellipse or may be a pattern drawn with fine lines such as an "H"-shape, a "Y"-shape, a "+" (plus or cross)-shape, or an "*" (asterisk)-shape. The planar shape of the recessed portion that defines the thin portion of the buffer portion may include, for example, a shape that serves as an outline of a polygonal shape, a rounded corner polygonal shape, a circular shape, or an elliptical shape. The recessed portion that defines the thin portion of the buffer portion may be a portion including: a recessed portion having a planar shape defining an outline as described above; and a recessed portion having a planar shape of any shape disposed inward of the outlines. The recessed portion that defines the thin portion of the buffer portion may have a planar shape that forms circumferences of, for example, concentric circles or may have a planar shape that outlines a plurality of circles, ellipses, polygons, rounded corner polygons, and the like in different sizes.

In each of the liquid crystal panels 100A to 100C described above, the sheet is disposed so as not to overlap the transmission and/or reception region R1 when viewed from the normal direction of the first dielectric substrate 1 or the second dielectric substrate 51. This configuration provides an advantage in that the influence of the sheet on the antenna performance of the scanning antenna need not be considered. Note that the sheet may be disposed at any location, provided that the influence on the antenna performance of the scanning antenna is small.

Figure 7A:
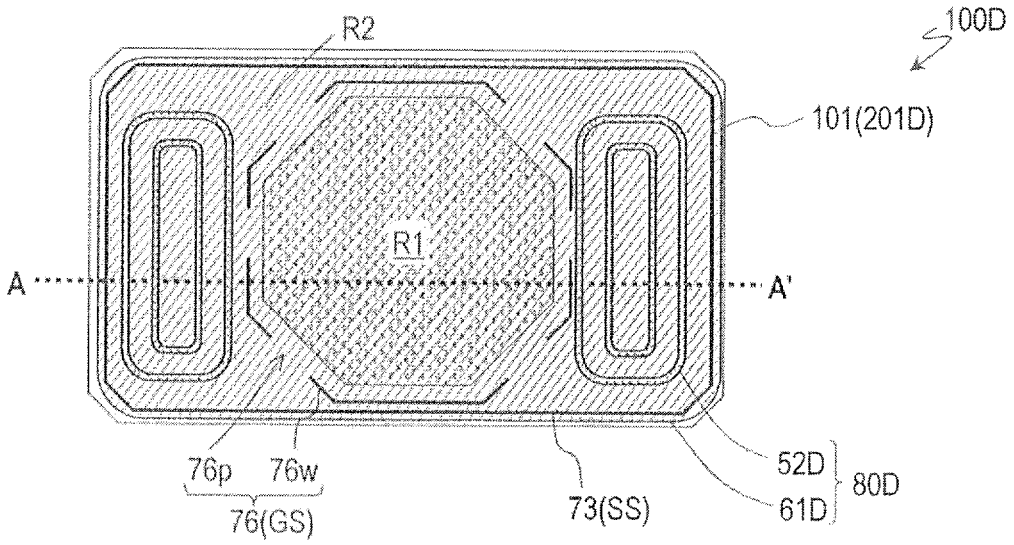
FIG. 7A is a plan view schematically illustrating a liquid crystal panel 100D according to yet another modification example of the first embodiment.
Figure 7B:
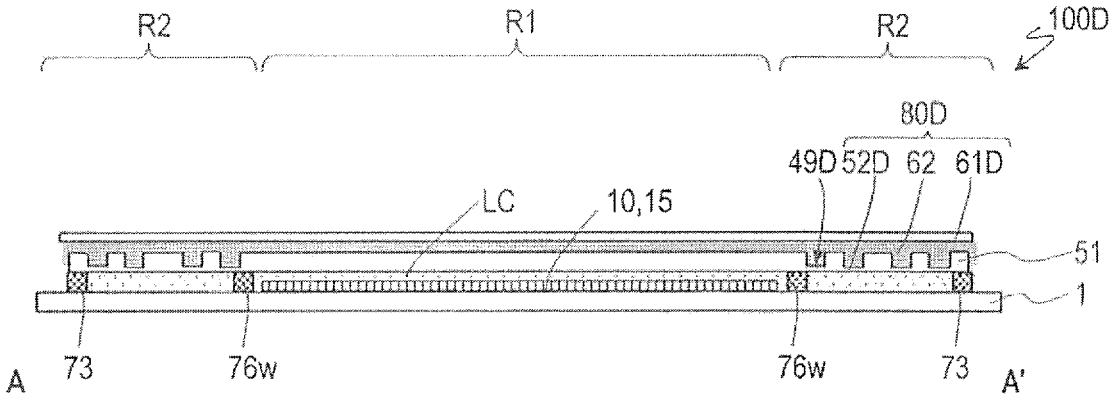
FIG. 7B is a cross-sectional view schematically illustrating the liquid crystal panel 100D.
Figure 7C:
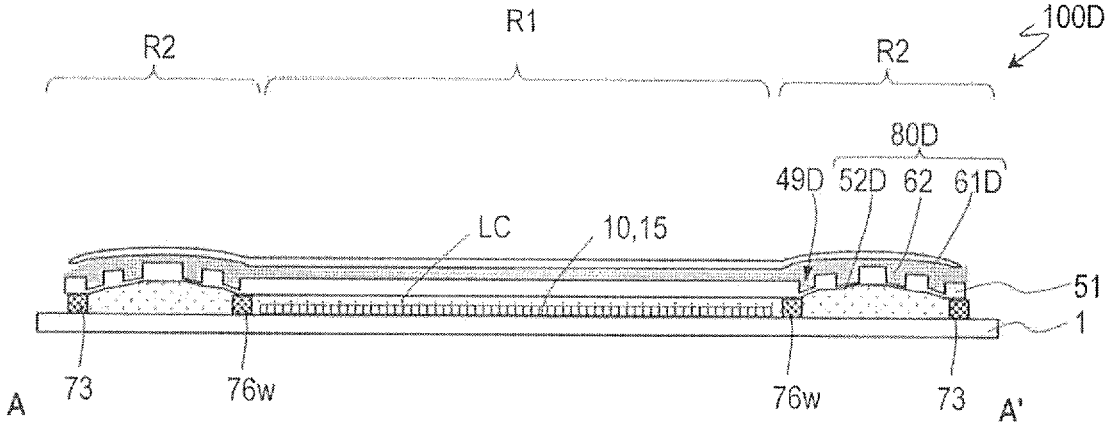
FIG. 7C is a cross-sectional view schematically illustrating the liquid crystal panel 100D.

FIGS. 7A, 7B, and 7C illustrate a liquid crystal panel 100D according to yet another modification example of the present embodiment. FIG. 7A is a plan view schematically illustrating the liquid crystal panel 100D, and FIGS. 7B and 7C are cross-sectional views schematically illustrating the liquid crystal panel 100D. FIGS. 7B and 7C illustrate cross sections taken along the line A-A' in FIG. 7A. FIG. 7C illustrates the liquid crystal panel 100D at an environmental temperature higher than that illustrated in FIG. 7B, and FIG. 7B illustrates the liquid crystal panel 100D at, for example, room temperature.

The liquid crystal panel 100D illustrated in FIGS. 7A, 7B, and 7C differs from the liquid crystal panel 100A illustrated in FIGS. 3A, 3B, and 3C in that a sheet 61D is provided on substantially the entire surface of the dielectric substrate 51. The sheet 61D may be any sheet provided that influence on the operation of the antenna is small. For example, a light-blocking film (a film that reflects or absorbs ultraviolet light and/or visible light) provided in the transmission and/or reception region R1 may extend to the non-transmission and/or reception region R2.

Even with the liquid crystal panel 100D, the same effects as the scanning antenna including the liquid crystal panel 100A can be obtained.

The liquid crystal panel 100D can be applied to any of the above-described scanning antennas including a liquid crystal panel. For example, a recessed portion 49D that defines a thin portion in a buffer portion 80D of the liquid crystal panel 100D may have any planar shape. For example, any of the modification examples of the planar shapes for the recessed portion described above may be applied.

Figure 8:
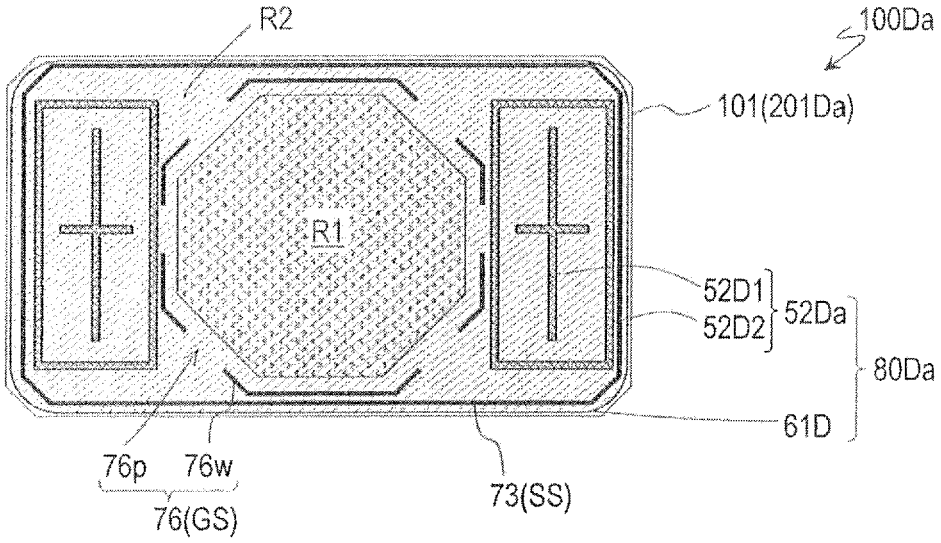
FIG. 8 is a plan view schematically illustrating a liquid crystal panel 100Da according to yet another modification example of the first embodiment.

FIG. 8 illustrates a liquid crystal panel 100Da according to a modification example of the liquid crystal panel 100D. FIG. 8 is a plan view schematically illustrating the liquid crystal panel 100Da. A buffer portion 80Da in the liquid crystal panel 100Da differs from, in terms of the planar shape of the thin portion 52Da of the second dielectric substrate 51, the thin portion 52D of the buffer portion 80D of the liquid crystal panel 100D. The thin portion 52Da includes a thin portion 52D1 having a cross-shaped planar shape and a thin portion 52D2 that outlines a square around the thin portion 52D1.

Each of the liquid crystal panels 100A to 100D described above has two buffer portions, and the two buffer portions are disposed on either side of the transmission and/or reception region R1. In the illustrated example, when viewed from the normal direction of the dielectric substrate 1 or 51, the transmission and/or reception region R1 is a regular octagon, and the liquid crystal panel 100A to 100D has a long, horizontal shape. The liquid crystal panel 100A to 100D is point symmetrical with respect to the center point when viewed from the normal direction of the dielectric substrate 1 or 51. Note that the positional relationship between the transmission and/or reception region R1 and the buffer portion is not limited to that illustrated. Additionally, it is sufficient that at least one buffer portion be provided.

Figure 9:
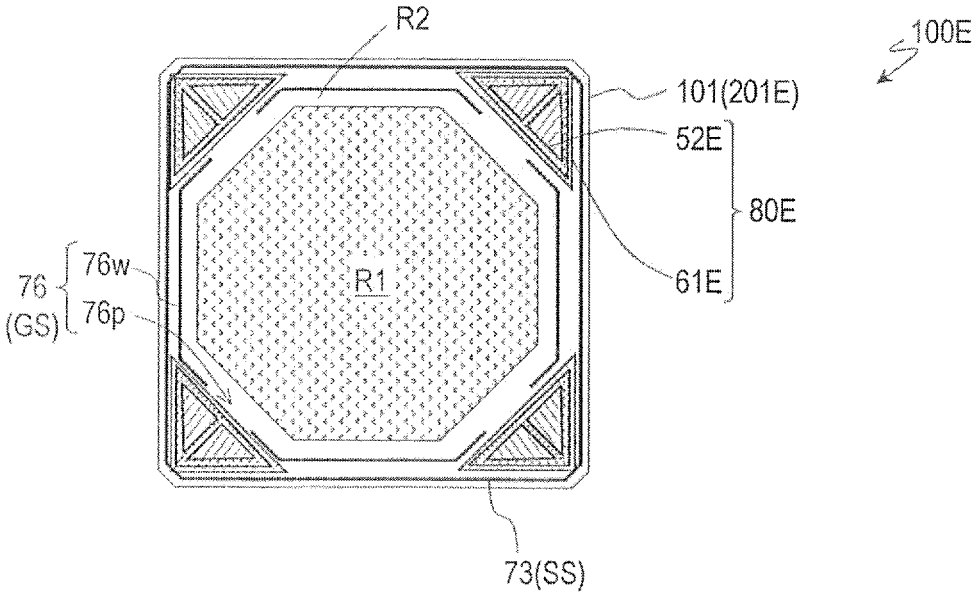
FIG. 9 is a plan view schematically illustrating a liquid crystal panel 100E according to yet another modification example of the first embodiment.

FIG. 9 illustrates a liquid crystal panel 100E according to yet another modification example of the present embodiment. FIG. 9 is a plan view schematically illustrating the liquid crystal panel 100E. The liquid crystal panel 100E is four-fold symmetrical with respect to the center point when viewed from the normal direction of the dielectric substrate 1 or 51. The liquid crystal panel 100E includes buffer portions 80E disposed in regions opposing every second side (total four sides) of the sides of the regular octagonal transmission and/or reception region R1.

Even with the liquid crystal panel 100E, the same effects as the scanning antenna including the liquid crystal panel 100A can be obtained. Further, because the liquid crystal panel 100E is more symmetrical than the liquid crystal panel 100A, the effect of suppressing decrease in antenna performance is considered to be large.

While the above describes embodiments of a scanning antenna, the embodiments of the disclosure are not limited to a scanning antenna and may be broadly applied to a liquid crystal device having an effective region and a non-effective region in a region other than the effective region. In this case, the liquid crystal device includes: a first substrate having a first dielectric substrate, a second substrate having a second dielectric substrate, and a liquid crystal layer provided between the first substrate and the second substrate and in the entire effective region and a portion of the non-effective region. A liquid crystal device according to an embodiment of the disclosure further includes: a sealing seal portion that surrounds the liquid crystal layer and is configured to define the maximum value of the area of the liquid crystal layer when viewed from a normal direction of the first or second dielectric substrate; a cell gap control seal portion configured to define the minimum value of the thickness of the liquid crystal layer in the effective region; and at least one buffer portion disposed in contact with the liquid crystal layer in the non-effective region and that deforms more easily due to external force than the first and second dielectric substrates in the effective region. The at least one buffer portion includes: a sheet; and a joining section that joins the sheet and the first dielectric substrate or the second dielectric substrate. The sheet deforms more easily due to external force than the first and second dielectric substrates in the effective region, and/or at least a portion of the joining section deforms more easily due to external force than the cell gap control seal portion. In the liquid crystal device according to an embodiment of the disclosure, the buffer portion deforms more greatly than the first dielectric substrate and the second dielectric substrate in the effective region when the volume of liquid crystal material constituting the liquid crystal layer changes (increases or decreases). Thus, changes in the thickness of the liquid crystal layer in the effective region are suppressed. As a result, influence on the function of the liquid crystal device caused by changes in the thickness of the liquid crystal layer is reduced.

The liquid crystal device includes, for example, a scanning antenna, an LCD panel, a light modulation element, and an optical element. When referring to liquid crystal devices, the terms "effective region" and "non-effective region" are used. An effective region is a region for expressing the function of the liquid crystal device and includes the liquid crystal layer. The non-effective region is a region located in a region other than the effective region. For example, in the scanning antenna, the effective region is a transmission and/or reception region including a plurality of antenna units, and the non-effective region is a non-transmission and/or reception region. In the LCD panel, the effective region is a display region having a plurality of pixels, and the non-effective region is a frame region (non-display region). In the light modulating element, the effective region is a region in which light is transmitted and/or reflected, and the non-effective region is a region other than that region. When the thickness of the liquid crystal layer in the effective region of the liquid crystal device changes, the function of the liquid crystal device may be affected. However, the function of the liquid crystal device is not affected or hardly affected by changes in the thickness of the liquid crystal layer in the non-effective region. In a scanning antenna or an LCD panel, the effective region has a plurality of liquid crystal capacitances, and each of the liquid crystal capacitances is made up of a pair of electrodes and a liquid crystal layer disposed between the pair of electrodes. A TFT is connected to each liquid crystal capacitance, and voltage is applied to each liquid crystal capacitance via the TFT. When the thickness of the liquid crystal layer constituting the liquid crystal capacitance changes, the electrostatic capacitance value of the liquid crystal capacitance changes, and this may affect the function of the liquid crystal device.

JP 2005-107127 A discloses a liquid crystal sealing element including: two transparent substrates disposed facing each other; a liquid crystal layer disposed therebetween; and a sealing member for sealing the liquid crystal layer. The liquid crystal sealing element can impart optical modulation to light passing through the liquid crystal layer and can be applied to optical devices, such as optical head devices that record and reproduce information to a CD, a DVD, or the like and laser beam printers. When the thickness of the liquid crystal layer varies depending on environmental temperature and location, the in-plane retardation of the liquid crystal sealing element is no longer constant. The liquid crystal sealing element described in JP 2005-107127 A has a region in which the thickness of the transparent substrate is small, outside the effective region for passing light. As a result, fluctuations in the function of the liquid crystal sealing element are suppressed even when the thickness of the liquid crystal layer fluctuates due to environmental temperature.

In the liquid crystal sealing element described in JP 2005-107127 A, it is conceivable that problems caused by decrease in the mechanical strength of the transparent substrate (e.g., breakage or cracking during transport and other times) occur when the transparent substrate is made thinner outside the effective region. Likewise, it is conceivable that setting the thickness of a partially thin portion of the transparent substrate to ensure the mechanical strength of the transparent substrate makes it difficult to sufficiently suppress variations in the thickness of the liquid crystal layer in the effective region. In order to deal with these problems, the buffer portion of the liquid crystal device according to embodiments of the disclosure includes a sheet. With such a configuration, it is possible to reinforce the dielectric substrate even if the mechanical strength of the dielectric substrate decreases when the dielectric substrate is partially thinned. Therefore, the occurrence of breakage or cracking during, for example, the transport of the dielectric substrate is suppressed. The liquid crystal device according to embodiments of the disclosure may be suitably used as a liquid crystal device for applications where mechanical strength against external force and vibration is required, such as in mobile devices or vehicles.

Figure 10:
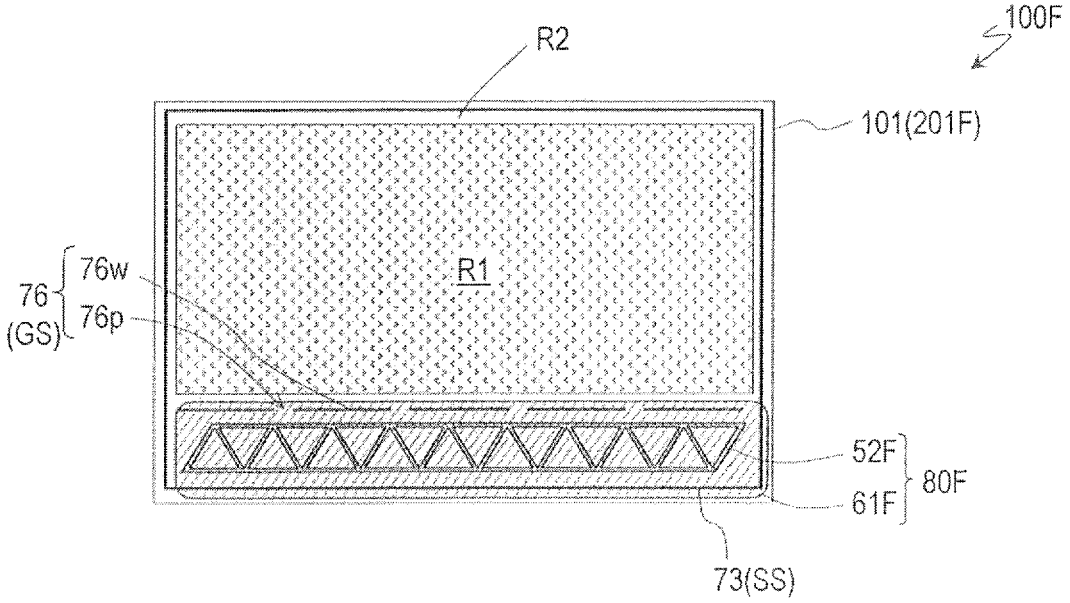
FIG. 10 is a plan view schematically illustrating a liquid crystal panel 100F according to yet another modification example of the first embodiment.

Another example of a liquid crystal panel used in a liquid crystal device according to an embodiment of the disclosure is illustrated in FIG. 10. FIG. 10 is a plan view schematically illustrating a liquid crystal panel 100F.

Depending on the application of the liquid crystal device using the liquid crystal panel, the shapes of the effective region (transmission and/or reception region) and the buffer portion when viewed from the normal direction of the dielectric substrate 1 or 51; and the positional relationship between these components may be changed. As with the liquid crystal panel 100E illustrated in FIG. 9, disposing the buffer region as equally as possible around the transmission and/or reception region R1 can also increase the effect of suppressing a decrease in antenna performance. Alternatively, as in the liquid crystal panel 100F illustrated in FIG. 10, a buffer portion 80F may only be disposed at one portion. For example, in a liquid crystal device (e.g., a liquid crystal panel) that uses the liquid crystal panel 100F, the buffer portion 80F can be made less noticeable by disposing a speaker, a remote control light receiver, or the like so as to overlap the buffer portion 80F.

Any of the liquid crystal panels described above can also be applied to a liquid crystal device other than a scanning antenna. For example, the sheet included in the buffer portion may be disposed anywhere, provided that influence on the function of the liquid crystal device is small. For example, in a configuration where a transparent sheet is used as the sheet in the buffer portion of an LCD panel, the sheet can be disposed on substantially the entire surface of the dielectric substrate including the effective region (display region), as in the liquid crystal panel 100D illustrated in FIG. 7A. Of course, the sheet may be disposed so as not to overlap the effective region when viewed from the normal direction of the first dielectric substrate or the second dielectric substrate.

Second Embodiment

In the previous embodiment, the buffer portion includes: a thin portion defined by a recessed portion formed in a surface of the first dielectric substrate 1 or the second dielectric substrate 51; a sheet that deforms more easily due to external force than the first dielectric substrate 1 and the second dielectric substrate 51 in the transmission and/or reception region R1; and a joining section (adhesive layer) that joins the sheet and the first dielectric substrate 1 or the second dielectric substrate 51. In the present embodiment, the buffer portion differs from the first embodiment in that the buffer portion includes: a through-hole formed in the first dielectric substrate 1 or the second dielectric substrate 51; a sheet that covers the through-hole; and a joining section (adhesive layer) that joins the sheet and the first dielectric substrate 1 or the second dielectric substrate 51. The following mainly describes differences to the previous embodiment. The same applies to subsequent embodiments.

Figure 11A:
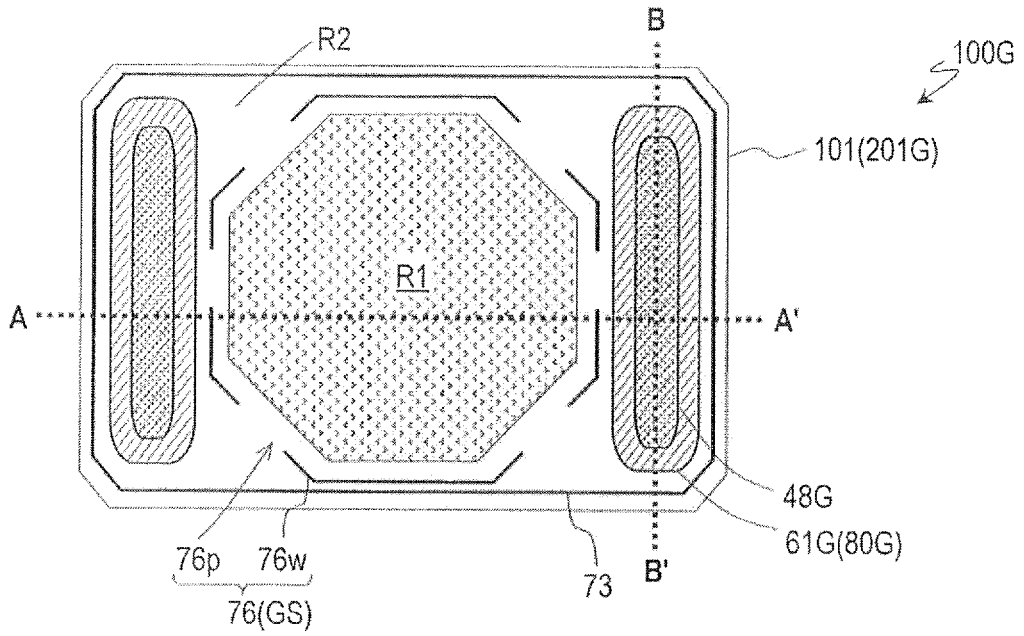
FIG. 11A is a plan view schematically illustrating a liquid crystal panel 100G included in a liquid crystal device (scanning antenna) according to a second embodiment of the disclosure.
Figure 11B:
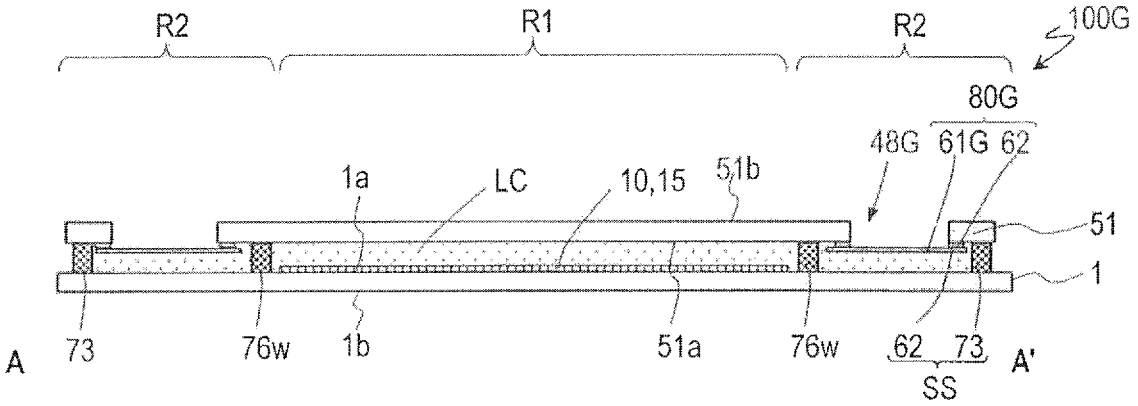
FIG. 11B is a cross-sectional view schematically illustrating the liquid crystal panel 100G.
Figure 11C:
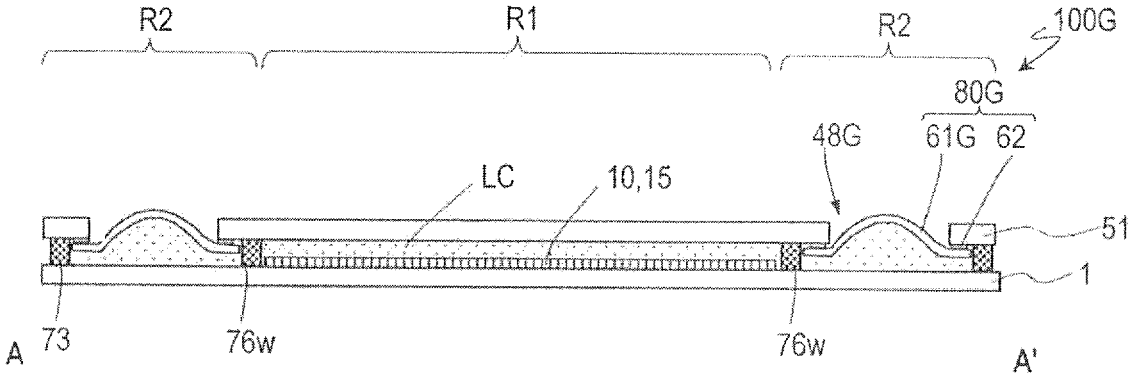
FIG. 11C is a cross-sectional view schematically illustrating the liquid crystal panel 100G.
Figure 11D:
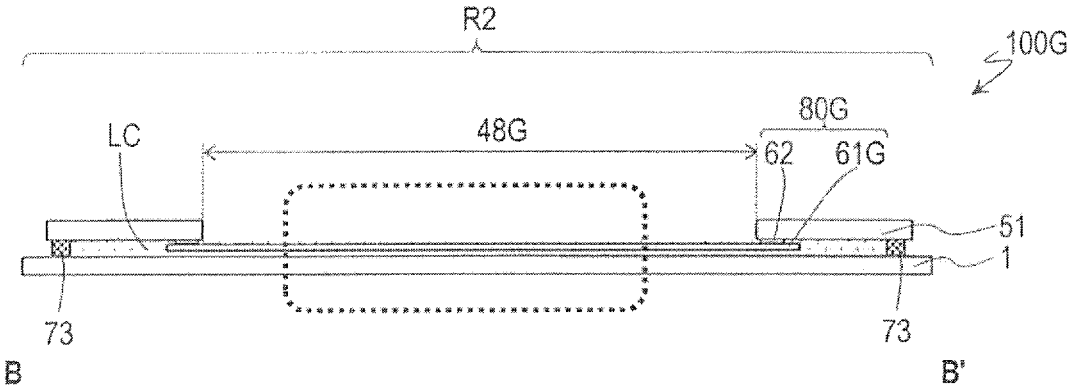
FIG. 11D is a cross-sectional view schematically illustrating the liquid crystal panel 100G.
Figure 11E:
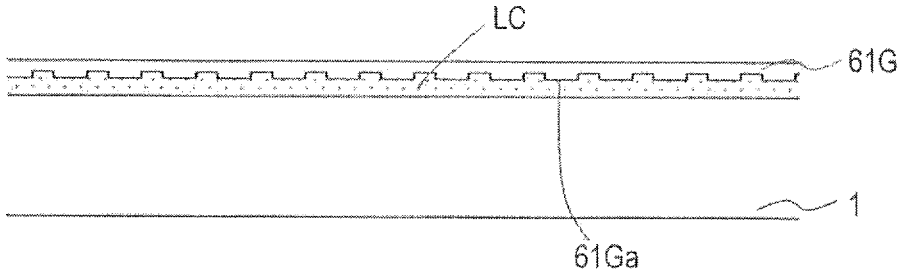
FIG. 11E is a cross-sectional view schematically illustrating the liquid crystal panel 100G and is an enlarged view of the region surrounded by the dotted line in FIG. 11D.
Figure 11F:
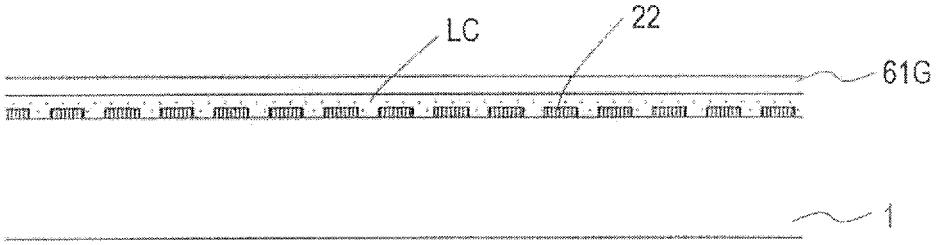
FIG. 11F is a cross-sectional view schematically illustrating the liquid crystal panel 100G and is an enlarged view of the region surrounded by the dotted line in FIG. 11D.

A liquid crystal panel 100G used in a liquid crystal device according to the second embodiment of the disclosure will be described with reference to FIGS. 11A, 11B, 11C, 11D, 11E, and 11F. FIG. 11A is a plan view schematically illustrating the liquid crystal panel 100G, and FIGS. 11B, 11C, and 11D are cross-sectional views schematically illustrating the liquid crystal panel 100G. FIGS. 11B and 11C illustrate cross sections taken along the line A-A' in FIG. 11A. FIG. 11C illustrates the liquid crystal panel 100G at an environmental temperature higher than that in FIG. 11B, and FIG. 11B illustrates the liquid crystal panel 100G at, for example, room temperature. FIG. 11D illustrates a cross section taken along the line B-B' in FIG. 11A, and FIGS. 11E and 11F are enlarged views of the region surrounded by the dotted line in FIG. 11D.

As illustrated in FIGS. 11A and 11B, the buffer portion 80G includes: a sheet 61G that covers a through-hole 48G formed in the second dielectric substrate 51; and the joining section (adhesive layer) 62 that joins the sheet 61G and the dielectric substrate 51. The sheet 61G deforms more easily due to external force than the first dielectric substrate 1 and the second dielectric substrate 51 in the transmission and/or reception region R1. In this example, the sheet 61G is disposed on the second dielectric substrate 51 closer to the liquid crystal layer LC. The buffer portion 80G deforms more easily due to external force than the first dielectric substrate 1 and the second dielectric substrate 51 in the transmission and/or reception region R1. As illustrated in FIG. 11C, the buffer portion 80G deforms more greatly than the first dielectric substrate 1 and the second dielectric substrate 51 in the transmission and/or reception region R1 when the liquid crystal material constituting the liquid crystal layer LC expands. Thus, the buffer portion 80G acts to suppress changes in the thickness of the liquid crystal layer LC in the transmission and/or reception region R1. In a scanning antenna including the liquid crystal panel 100G, changes in the thickness of the liquid crystal layer LC between the patch electrode 15 and the slot electrode 55 are suppressed, thereby suppressing decrease in antenna performance. In a liquid crystal device including the liquid crystal panel 100G, changes in the thickness of the liquid crystal layer LC in the effective region R1 are suppressed, and hence influence on the function of the liquid crystal device caused by changes in the thickness of the liquid crystal layer LC is reduced.

The sheet 61G is fixed to the first main surface 51*a* of the second dielectric substrate 51 via the adhesive layer 62, for example. Although not illustrated in the plan view, the adhesive layer 62 is disposed so as to overlap the sheet 61G and not overlap the through-hole 48G when viewed from the normal direction of the dielectric substrate 51. For example, when viewed from the normal direction of the dielectric substrate 51, the adhesive layer 62 is disposed only on a peripheral portion of the sheet 61G (portion at or near the edge of the sheet 61G). In the present embodiment, the adhesive layer 62 and the seal portion 73 constitute the sealing seal portion SS.

As illustrated in FIG. 11D, the sheet 61G may be in contact with the liquid crystal layer LC at the buffer portion 80G of the liquid crystal panel 100G. For example, as illustrated in FIG. 11E, in the buffer portion 80G, a surface (main surface) 61Ga of the sheet 61G closer to the liquid crystal layer LC has irregularities. Forming the surface (main surface) 61Ga of the sheet 61G closer to the liquid crystal layer LC with irregularities facilitates the movement of the liquid crystal material in contact with the sheet 61G. Alternatively, as illustrated in FIG. 11F, irregularities may be formed on the surface of the liquid crystal layer LC of the TFT substrate 101 in the region where the buffer portion 80G is provided. An effect of the liquid crystal material easily moving is obtained even when the surface of the liquid crystal layer LC of the TFT substrate 101 has irregularities. Irregularities are formed by, for example, forming protruding portions 22 on the dielectric substrate 1 in the non-transmission and/or reception region R2, using the conductive layer included in the TFT substrate 101. The irregularities described above include a plurality of recessed portions (e.g., grooves) and/or a plurality of protruding portions. The irregularities may have any shape.

The buffer portion included in the liquid crystal device according to the present embodiment is not limited to that illustrated. The buffer portion may include a sheet disposed further from the liquid crystal layer LC than the second dielectric substrate 51. The buffer portion may include a sheet that covers the through-hole formed in the first dielectric substrate 1. In this case, the sheet may be disposed further from the liquid crystal layer LC than the first dielectric substrate 1 or may be close to the liquid crystal layer LC.

The buffer portion in the liquid crystal device according to the present embodiment is not limited to including, as the sheet that covers the through-hole formed in the first or second dielectric substrate, a sheet that deforms more easily due to external force than the first dielectric substrate 1 and the second dielectric substrate 51 in the transmission and/or reception region R1. The sheet may deform less easily or at the same degree due to external force as the first dielectric substrate 1 and the second dielectric substrate 51 in the transmission and/or reception region R1. For example, using a hard sheet such as a glass sheet is advantageous in that the liquid crystal panel has high mechanical strength. In this case, a joining section that deforms more easily due to external force than the cell gap control seal portion GS is used as the joining section that joins the sheet and the first or second dielectric substrate. For example, the joining section (adhesive layer) may be formed of a rubber resin, or the joining section may be formed by sandwiching silicone rubber, urethane rubber, or the like with an adhesive layer. Note that, even in cases where the joining section deforms more easily due to external force than the cell gap control seal portion, a sheet that deforms more easily due to external force than the first dielectric substrate 1 and the second dielectric substrate 51 in the transmission and/or reception region R1 may be used as the sheet. A joining section that deforms more easily due to external force than the cell gap control seal portion is effective, when applied to a joining section that joins the first or second dielectric substrate and a sheet disposed further from the liquid crystal layer LC than the first or second dielectric substrate.

Figure 12A:
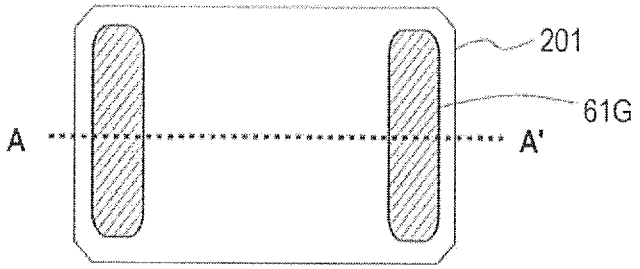
FIG. 12A is a schematic diagram for explaining a manufacturing method of the liquid crystal panel 100G.
Figure 12B:
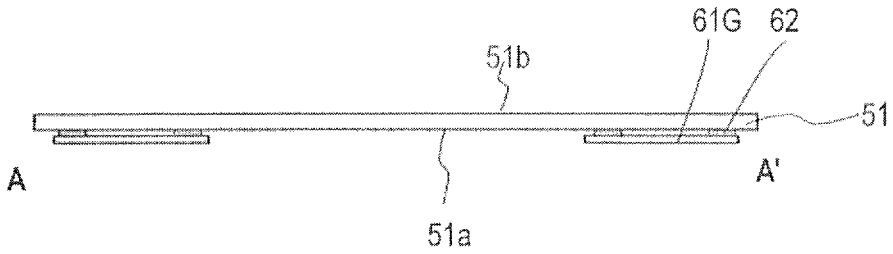
FIG. 12B is a schematic diagram for explaining a manufacturing method of the liquid crystal panel 100G.
Figure 12C:
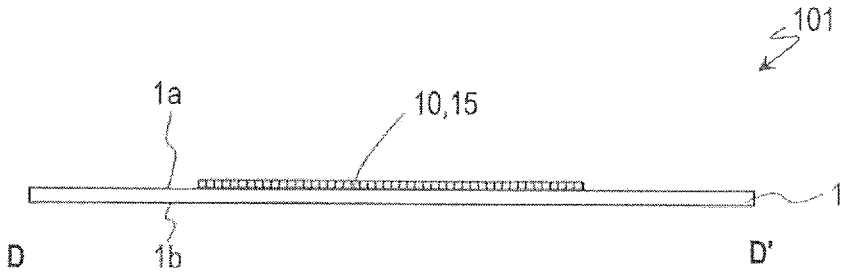
FIG. 12C is a schematic diagram for explaining a manufacturing method of the liquid crystal panel 100G.

Manufacturing Method of Liquid Crystal Panel 100G A manufacturing method of the liquid crystal panel 100G will be described with reference to FIGS. 12A, 12B, 12C, and 12D. FIGS. 12A, 12B, 12C, and 12D are schematic diagrams for explaining a manufacturing method of the liquid crystal panel 100G. FIG. 12B illustrates a cross section taken along the line A-A' in FIG. 12A, and FIG. 12C illustrates a cross section taken along the line D-D' in FIG. 12D.

Figure 12D:
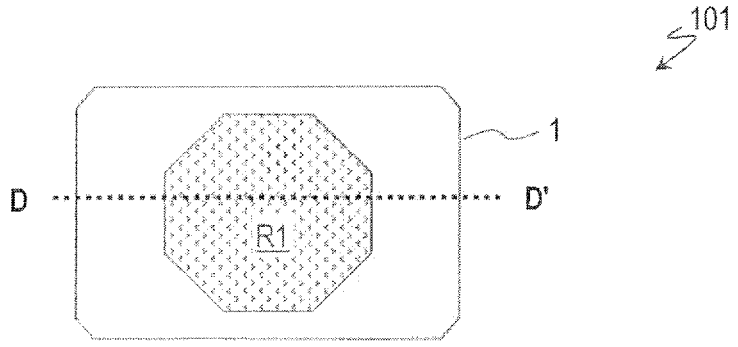
FIG. 12D is a schematic diagram for explaining a manufacturing method of the liquid crystal panel 100G.

First, as illustrated in FIGS. 12A and 12B, the slot substrate 201 is prepared using a known method. The slot substrate 201 includes: the dielectric substrate 51; and constituent elements such as the slot electrode 55 on the first main surface 51*a* of the dielectric substrate 51. Then, the sheet 61G is fixed to the first main surface 51*a* of the dielectric substrate 51 via the adhesive layer 62. As illustrated in FIGS. 12C and 12D, the TFT substrate 101 is prepared using a known method. The TFT substrate 101 includes: the dielectric substrate 1; and constituent elements such as the TFTs 10 and the patch electrodes 15 on the first main surface 1*a* of the dielectric substrate 1.

Next, the TFT substrate 101 and the slot substrate 201 are bonded together by forming the seal portion 73 while the first main surface 1*a* of the dielectric substrate 1 and the first main surface 51*a* of the dielectric substrate 51 face each other. The seal portion 73 can be formed using the same method as in the previous embodiment.

Next, the liquid crystal layer LC is formed. The liquid crystal layer LC can be formed using vacuum injection or one drop filling.

The dielectric substrate 51 is then etched from the second main surface 51*b* to form the through-hole 48G that reaches the sheet 61G. A protecting member is provided to expose only the portion of the second main surface 51*b* of the dielectric substrate 51 to be etched and cover the rest of the liquid crystal panel.

Thus, the liquid crystal panel 100G is manufactured.

The step of forming the through-hole 48G may be performed before bonding the TFT substrate 101 and the slot substrate 201. After the slot substrate 201 illustrated in FIGS. 12A and 12B is prepared, the through-hole 48G is formed by partially etching the dielectric substrate 51. At this time, a protecting member is provided to expose only the portion of the surface of the dielectric substrate 51 to be etched and cover the rest of the surface. Then, the sheet 61G covering the through-hole 48G is applied to the first main surface 51*a* of the dielectric substrate 51. Thereafter, the slot substrate 201 and the TFT substrate 101 are bonded together in the manner described above.

At this time, the sheet covering the through-hole 48G may be applied to the first main surface 51*a* of the dielectric substrate 51 (main surface closer to the liquid crystal layer LC) or may be applied to the second main surface 51*b* (main surface further from the liquid crystal layer LC).

A configuration in which the sheet is applied to the first main surface 51*a* of the dielectric substrate 51 (main surface closer to the liquid crystal layer LC) is advantageous in that the volume of liquid crystal material can be reduced. The sheet to be applied to the first main surface 51*a* of the dielectric substrate 51 (main surface closer to the liquid crystal layer LC) preferably has low reactivity with the liquid crystal material constituting the liquid crystal layer LC, and for example, a polyimide film can be used. A polyimide film is also preferable from the perspective of film thickness, heat resistance, and strength of the buffer portion. The polyimide film is fixed to the dielectric substrate using, for example, an epoxy resin-based adhesive. Alternatively, a stainless steel thin film can be used as the sheet applied to the first main surface 51*a* of the dielectric substrate 51 (main surface closer to the liquid crystal layer LC).

A configuration in which the sheet is applied to the second main surface 51*b* of the dielectric substrate 51 (main surface further from the liquid crystal layer LC) is advantageous in that the material and thickness of the sheet have a high degree of freedom. For example, a polyimide film, a silicone rubber sheet, and the like can be used.

In a case where a plurality of TFT substrates are prepared from a single mother glass substrate and where a plurality of slot substrates are prepared from a single mother glass substrate, after the mother glass substrates are bonded together to form the seal portion, portions corresponding to each liquid crystal panel need only be cut out by dicing or laser processing, for example, before the liquid crystal layer is formed by vacuum injection. Alternatively, in a case where one drop filling is used, a pattern serving as the seal portion may be drawn with the sealing member in portions corresponding to each liquid crystal panel on one of the mother glass substrates. Then, after the liquid crystal material is applied to the portions corresponding to each liquid crystal panel on one of the mother glass substrates, the mother glass substrates may be bonded together to form the seal portion and the liquid crystal layer. Each liquid crystal panel is then cut out. Regardless of which method is used to form the liquid crystal layers, in each liquid crystal panel that is cut out, the step of forming the through-hole may be performed by etching the second main surface (main surface further from the liquid crystal layer) of the dielectric substrate of the slot substrate, or the through-hole may be formed by partially etching at least one of the mother glass substrates before the mother glass substrates are bonded to each other. The order in which each liquid crystal panel portion is cut out may be appropriately changed depending on the size of the mother glass substrate and the size and shape of the liquid crystal panel.

In the example illustrated in FIGS. 11A, 11B, 11C, and 11D, the buffer portion includes: a sheet that covers the through-hole formed in the second dielectric substrate 51; and the joining section that joins the sheet and the second dielectric substrate 51. The buffer portion included in the liquid crystal device according to the present embodiment is not limited thereto and may include: a sheet that covers a through-hole formed in the first dielectric substrate 1; and a joining section that joins the sheet and the first dielectric substrate 1. Modification examples of the previous embodiments may also be applied. The through-hole may have any planar shape.

Modification Example

Figure 13A:
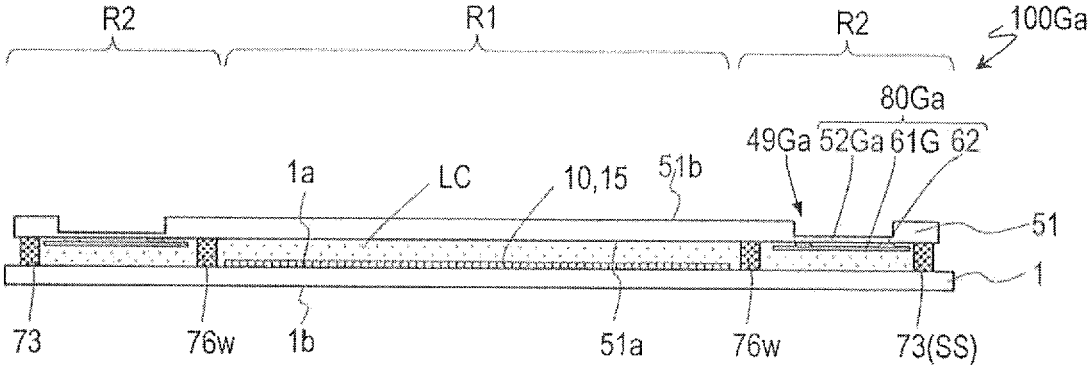
FIG. 13A is a cross-sectional view schematically illustrating a liquid crystal panel 100Ga according to a modification example of the second embodiment.

FIG. 13A illustrates a liquid crystal panel 100Ga according to a modification example of the present embodiment. FIG. 13A is a cross-sectional view schematically illustrating the liquid crystal panel 100Ga.

The dielectric substrate 51 of the liquid crystal panel 100Ga differs from the dielectric substrate 51 of the liquid crystal panel 100G formed with the through-hole 48G in that it has a recessed portion 49Ga formed in the second main surface 51*b* (main surface further from the liquid crystal layer LC). A buffer portion 80Ga in the liquid crystal panel 100Ga includes: a thin portion 52Ga defined by the recessed portion 49Ga; the sheet 61G disposed on the second dielectric substrate 51 closer to the liquid crystal layer LC; and the adhesive layer 62. Here, the seal portion 73 constitutes the sealing seal portion SS.

Even with the liquid crystal panel 100Ga, changes in the thickness of the liquid crystal layer LC in the transmission and/or reception region R1 can be suppressed. As described in the previous embodiment, the buffer portion 80Ga deforms more easily due to external force than the first dielectric substrate 1 and the second dielectric substrate 51 in the transmission and/or reception region R1.

The liquid crystal panel 100Ga can be manufactured by, for example, modifying the manufacturing method of the liquid crystal panel 100G as follows. In the step of etching the dielectric substrate 51 to form the through-hole 48G, etching may be stopped before a through-hole is formed in the dielectric substrate 51. As a result, the recessed portion 49Ga is formed in the second main surface 51*b* of the dielectric substrate 51. For example, etching may be stopped in a state where the thickness of the dielectric substrate 51 at the recessed portion is sufficiently smaller than 0.1 mm (e.g., less than or equal to 0.05 mm).

The liquid crystal panel 100Ga manufactured using such a method can reduce damage to the sheet 61G and/or the adhesive layer 62 caused by the etchant of the dielectric substrate 51 (e.g., glass substrate) more effectively than the liquid crystal panel 100G.

Figure 13B:
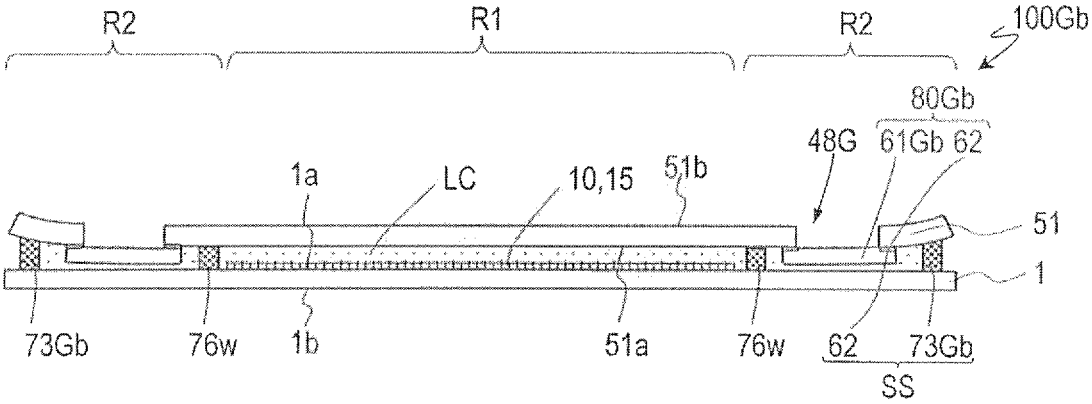
FIG. 13B is a cross-sectional view schematically illustrating a liquid crystal panel 100Gb according to another modification example of the second embodiment.

FIG. 13B illustrates a liquid crystal panel 100Gb according to another modification example of the present embodiment. FIG. 13B is a cross-sectional view schematically illustrating the liquid crystal panel 100Gb.

A buffer portion 80Gb in the liquid crystal panel 100Gb includes: a sheet 61Gb that covers the through-hole 48G in the dielectric substrate 51; and the adhesive layer 62 that joins the sheet 61Gb and the dielectric substrate 51. The thickness of the sheet 61Gb of the buffer portion 80Gb in the liquid crystal panel 100Gb (thickness in the normal direction of the dielectric substrate 51) is greater than the thickness of the sheet 61G of the buffer portion 80G in the liquid crystal panel 100G. The thickness of a seal portion 73Gb in the liquid crystal panel 100Gb is greater than the thickness of the inner structure 76 (cell gap control seal portion GS). For example, the particle size of the granular spacer (e.g., conductive particles such as beads or fillers) included in the inner structure 76 is larger than the particle size of the granular spacer (e.g., conductive particles such as beads or fillers) included in the seal portion 73Gb. In this example, the seal portion 73Gb and the joining section 62 constitute the sealing seal portion SS, similar to the liquid crystal panel 100G.

For example, in the liquid crystal panel 100G, when the thickness of the sheet 61G provided on the dielectric substrate 51 closer to the liquid crystal layer LC is greater than or equal to 99% with respect to the thickness of the liquid crystal layer LC in the transmission and/or reception region R1, the function of the buffer portion 80G including the sheet 61G may not be sufficiently achieved. In contrast, in the liquid crystal panel 100Gb, the thickness of the seal portion 73Gb is, for example, from 1% to 30% larger than the thickness of the inner structure 76 (cell gap control seal portion GS), and hence the function of the buffer portion 80Gb is achieved. In other words, changes in the thickness of the liquid crystal layer LC in the transmission and/or reception region R1 can be suppressed.

As described above, at least a portion of the seal portion 73Gb may be formed of a material (e.g., a rubber-based resin) that deforms more easily due to external force than the cell gap control seal GS. This also applies to the liquid crystal panel 100G. By forming at least a portion of the seal portion 73Gb of a material that easily deforms, the thick sheet 61Gb can be effectively used to suppress changes in the thickness of the liquid crystal layer LC in the transmission and/or reception region R1.

Figure 14B:
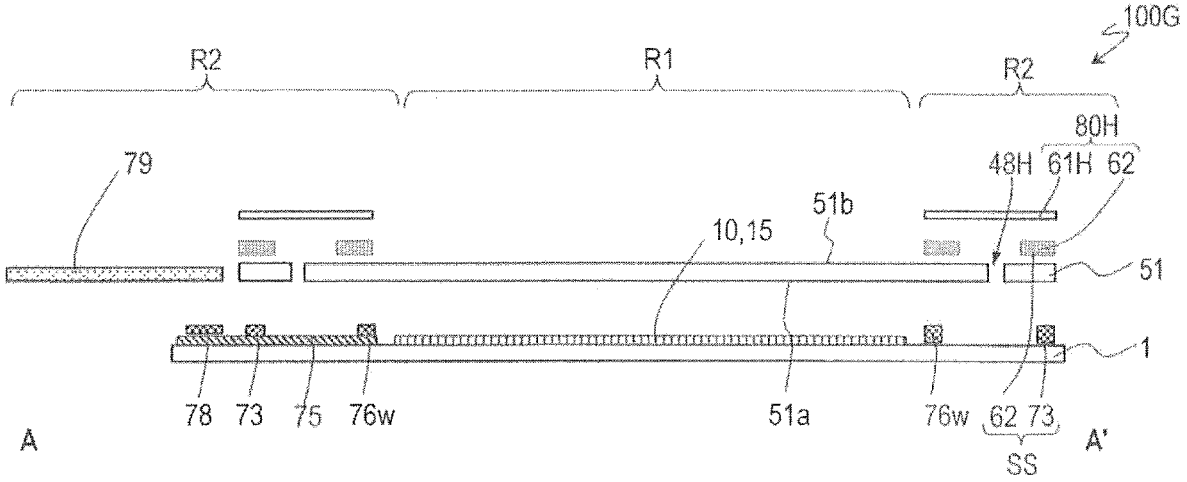
FIG. 14B is a diagram schematically illustrating an exploded cross-section of the liquid crystal panel 100H.
Figure 14C:
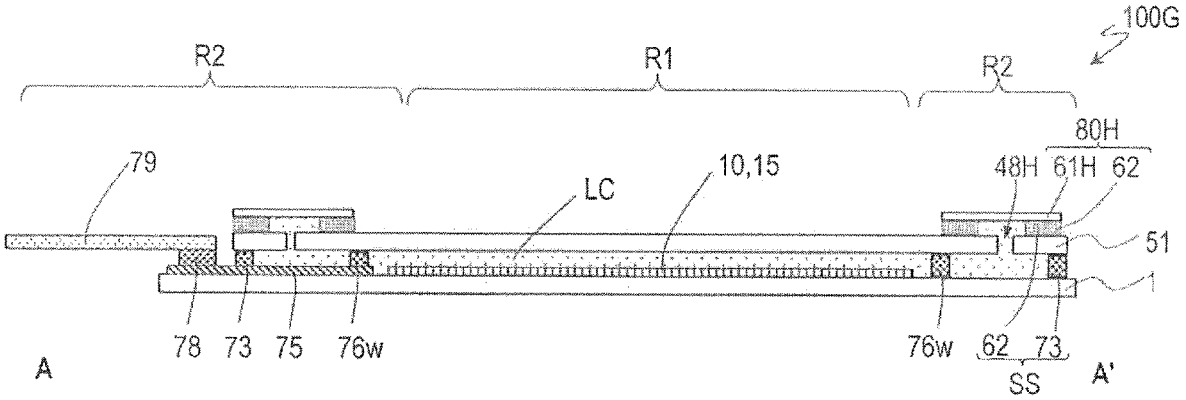
FIG. 14C is a cross-sectional view schematically illustrating the liquid crystal panel 100H.
Figure 14D:
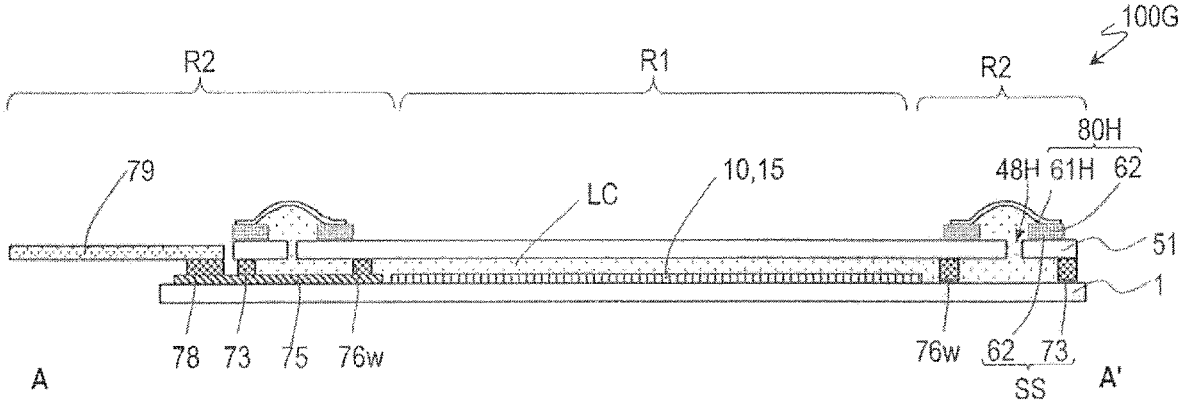
FIG. 14D is a cross-sectional view schematically illustrating the liquid crystal panel 100H.
Figure 14E:
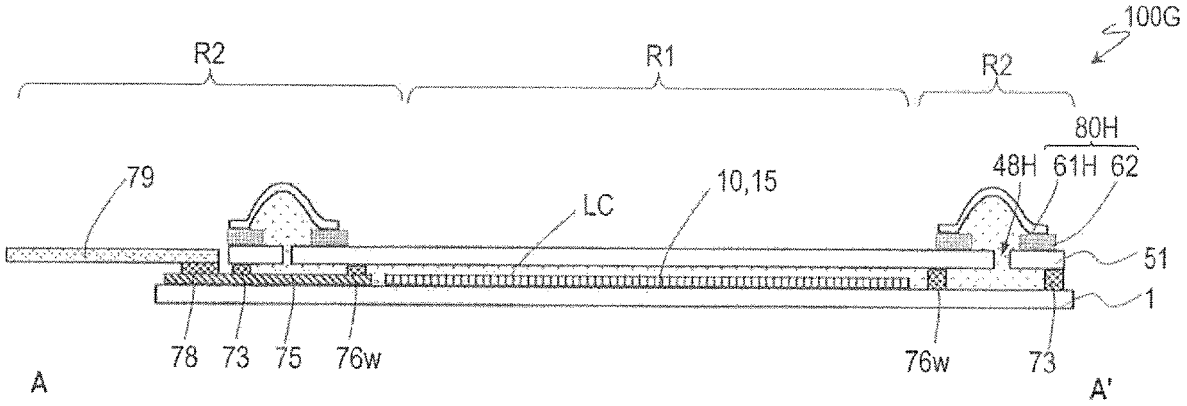
FIG. 14E is a cross-sectional view schematically illustrating the liquid crystal panel 100H.

FIGS. 14A, 14B, 14C, 14D, and 14E illustrate a liquid crystal panel 100H according to yet another modification example of the present embodiment. FIG. 14A is a plan view schematically illustrating the liquid crystal panel 100H. FIG. 14B is a diagram schematically illustrating an exploded cross-section of the liquid crystal panel 100H. FIGS. 14C, 14D, and 14E are cross-sectional views schematically illustrating the liquid crystal panel 100G. FIGS. 14B, 14C, 14D, and 14E illustrate a cross section taken along the line A-A' in FIG. 14A. FIG. 34C illustrates the liquid crystal panel 100H at, for example, room temperature. FIG. 14D illustrates the liquid crystal panel 100H at an environmental temperature higher than that in FIG. 14C. FIG. 14E illustrates the liquid crystal panel 100H at an even higher environmental temperature than in FIG. 14D.

As illustrated in FIGS. 14A and 14C, a buffer portion 80H in the liquid crystal panel 100H includes: a sheet 61H that covers a through-hole 48H formed in the second dielectric substrate 51 in the non-transmission and/or reception region R2; and the joining section 62 that joins the sheet 61H and the dielectric substrate 51. In this example, the sheet 61H is disposed on the second dielectric substrate 51 on a side opposite the liquid crystal layer LC. The buffer portion 80H deforms more easily due to external force than the first dielectric substrate 1 and the second dielectric substrate 51 in the transmission and/or reception region R1. As illustrated in FIGS. 14D and 14E, when the liquid crystal material constituting the liquid crystal layer LC expands, the buffer portion 80H deforms more greatly than the first dielectric substrate 1 and the second dielectric substrate 51 in the transmission and/or reception region R1 and thus acts to suppress changes in the thickness of the liquid crystal layer LC in the transmission and/or reception region R1. Even with the liquid crystal panel 100H, the same effects as the liquid crystal panel 100G can be obtained.

In this example, the sheet 61H is fixed to the second main surface 51*b* of the second dielectric substrate 51 via the adhesive layer 62 between the second dielectric substrate 51 and the sheet 61H. Although not illustrated in FIG. 14A, the adhesive layer 62 is disposed so as to overlap the sheet 61H and not to overlap the through-hole 48H when viewed from the normal direction of the dielectric substrate 51. When viewed from the normal direction of the dielectric substrate 51, the adhesive layer 62 is disposed only on a peripheral portion (portion at or near the edge of the sheet 61H) of the sheet 61H. Here, the seal portion 73 and the joining section 62 constitute the sealing seal portion SS.

As illustrated in FIGS. 14A and 14C, an FPC 79 is provided on the TFT substrate 101 in the non-transmission and/or reception region R2. For example, a drive circuit (gate driver and/or source driver) is provided on the FPC 79, and a terminal connected to the drive circuit is electrically connected to a lead-out wiring line 75 provided on the TFT substrate 101 by resin 78 including conductive beads. Signals supplied to the drive circuit are supplied to a gate bus line and/or a source bus line via the lead-out wiring line 75. The resin 78 including conductive beads may be formed of the same material as the seal portion 73.

Figure 15A:
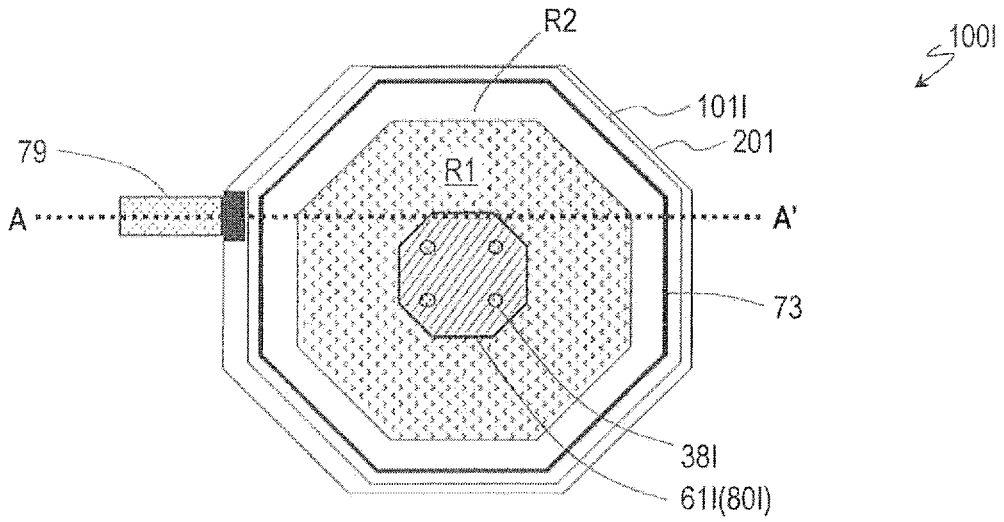
FIG. 15A is a plan view schematically illustrating a liquid crystal panel 100I according to yet another modification example of the second embodiment.
Figure 15B:
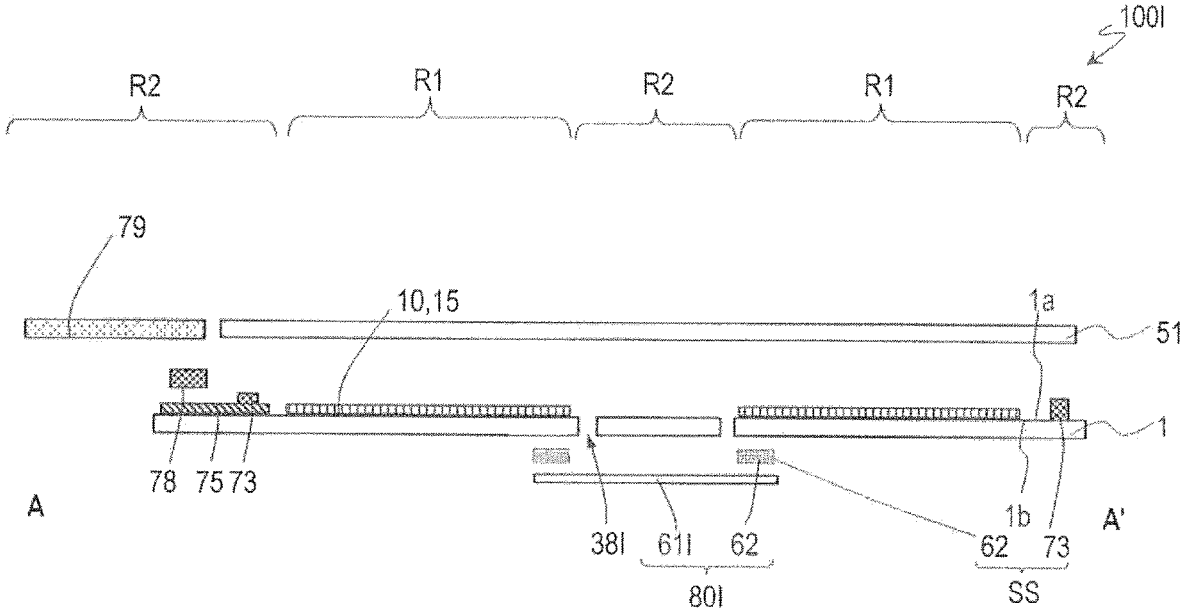
FIG. 15B is a diagram schematically illustrating an exploded cross-section of the liquid crystal panel 100I.
Figure 15C:
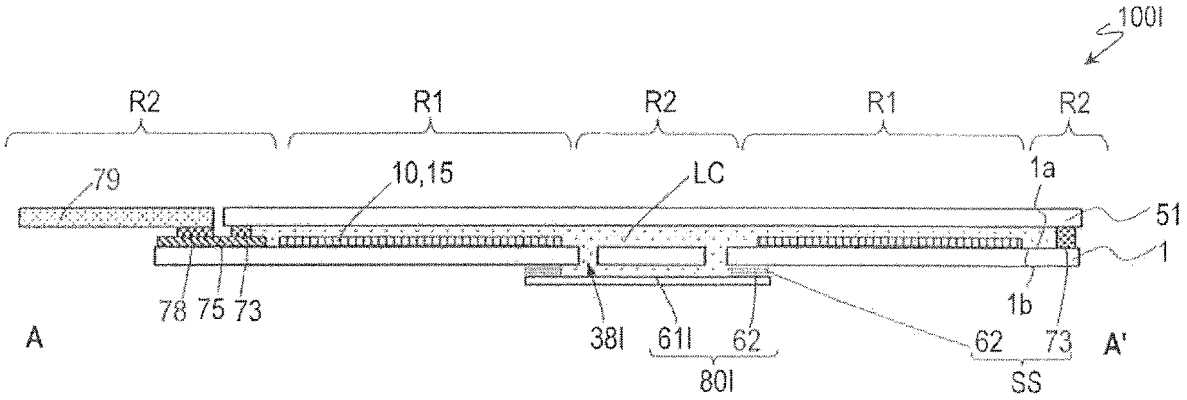
FIG. 15C is a cross-sectional view schematically illustrating the liquid crystal panel 100I.
Figure 15D:
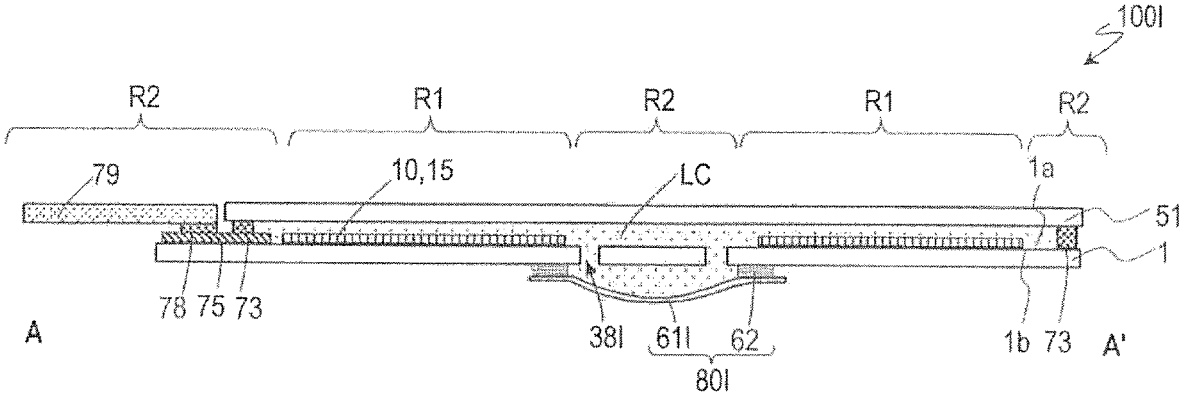
FIG. 15D is a cross-sectional view schematically illustrating the liquid crystal panel 100I.
Figure 15E:
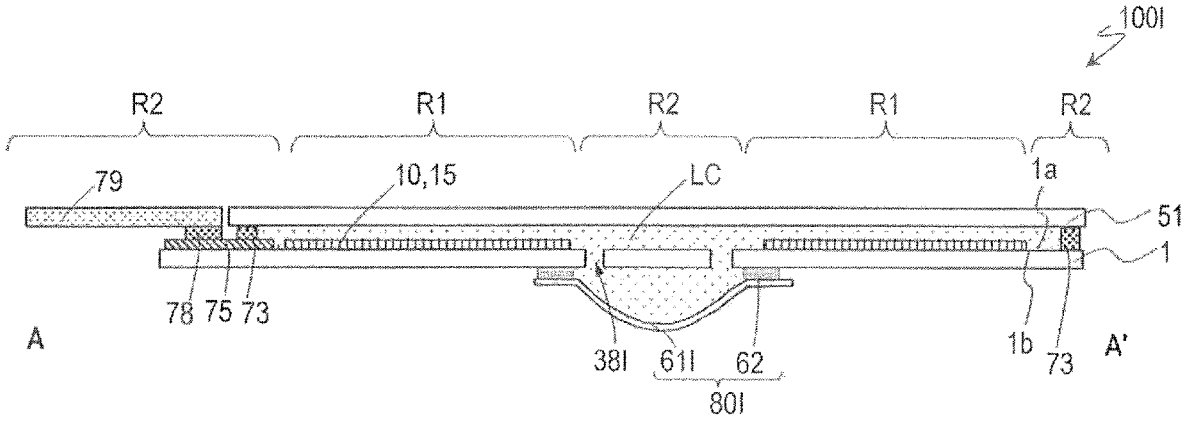
FIG. 15E is a cross-sectional view schematically illustrating the liquid crystal panel 100I.

FIGS. 15A, 15B, 15C, 15D, and 15E illustrate a liquid crystal panel 100I according to yet another modification example of the present embodiment. FIG. 15A is a plan view schematically illustrating the liquid crystal panel 100I. FIG. 15B is a diagram schematically illustrating an exploded cross-section of the liquid crystal panel 100I. FIGS. 15C, 15D, and 15E are cross-sectional views schematically illustrating the liquid crystal panel 100I. FIGS. 15B, 15C, 15D, and 15E illustrate a cross section taken along the line A-A' in FIG. 15A. FIG. 15C illustrates the liquid crystal panel 100I at, for example, room temperature. FIG. 15D illustrates the liquid crystal panel 100I at an environmental temperature higher than that in FIG. 15C. FIG. 15E illustrates the liquid crystal panel 100I at an even higher environmental temperature than that in FIG. 15D.

As illustrated in FIGS. 15A and 15C, a buffer portion 80I included in the liquid crystal panel 100I includes: a sheet 61I that covers a through-hole 381 formed in the first dielectric substrate 1 adhesive layer in the non-transmission and/or reception region R2; and the adhesive layer 62 that joins the sheet 61I and the first dielectric substrate 1. In this example, the sheet 61I is disposed on the first dielectric substrate 1 on a side opposite the liquid crystal layer LC. In the illustrated example, the transmission and/or reception region R1 has a donut-shape when viewed from the normal direction of a TFT substrate 1011. The buffer portion 80I deforms more easily due to external force than the first dielectric substrate 1 and the second dielectric substrate 51 in the transmission and/or reception region R1. As illustrated in FIGS. 15D and 15E, when the liquid crystal material constituting the liquid crystal layer LC expands, the buffer portion 80I deforms more greatly than the first dielectric substrate 1 and the second dielectric substrate 51 in the transmission and/or reception region R1 and thus acts to suppress changes in the thickness of the liquid crystal layer LC in the transmission and/or reception region R1. Even with the liquid crystal panel 100I, the same effects as the scanning antenna including the liquid crystal panel 100G can be obtained.

In this example, the sheet 61I is fixed to the second main surface 1*b* of the first dielectric substrate 1 with the adhesive layer 62 between the first dielectric substrate 1 and the sheet 61I. Although not illustrated in FIG. 15A, the adhesive layer 62 is disposed so as to overlap the sheet 61I and not to overlap the through-hole 381 when viewed from the normal direction of the dielectric substrate 1. When viewed from the normal direction of the dielectric substrate 51, the adhesive layer 62 is disposed only on a peripheral portion of the sheet 61I (portion at or near the edge of the sheet 61I). Here, the seal portion 73 and the joining section 62 constitute the sealing seal portion SS.

Third Embodiment

Figure 16A:
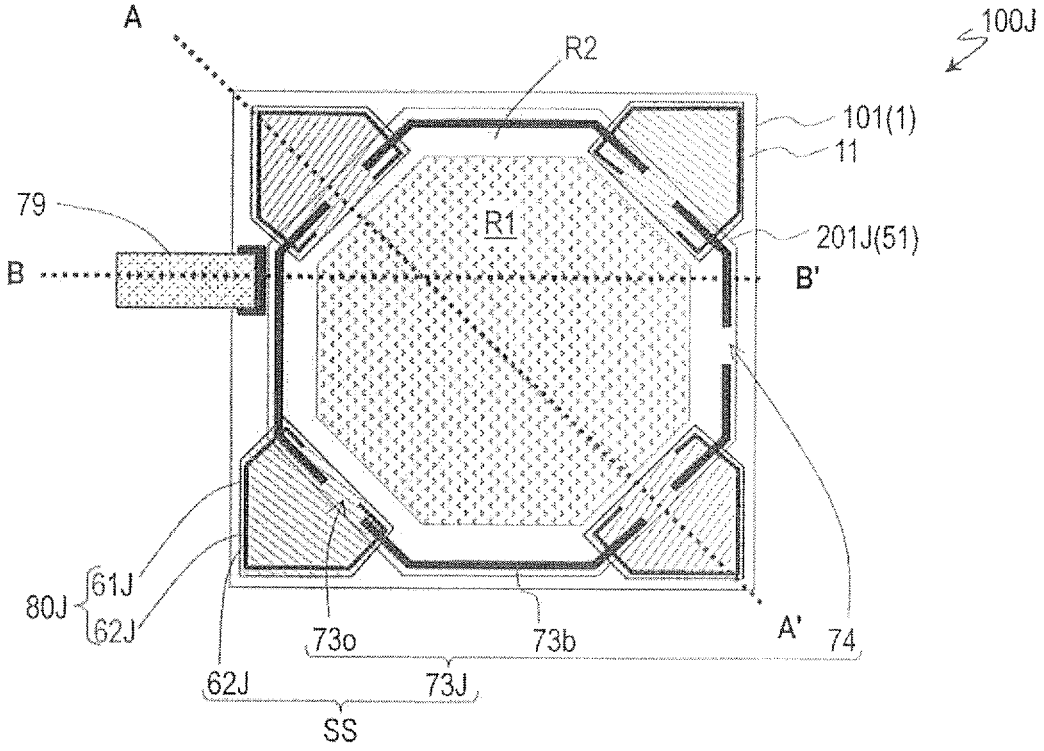
FIG. 16A is a plan view schematically illustrating a liquid crystal panel 100J according to a third embodiment.
Figure 16B:
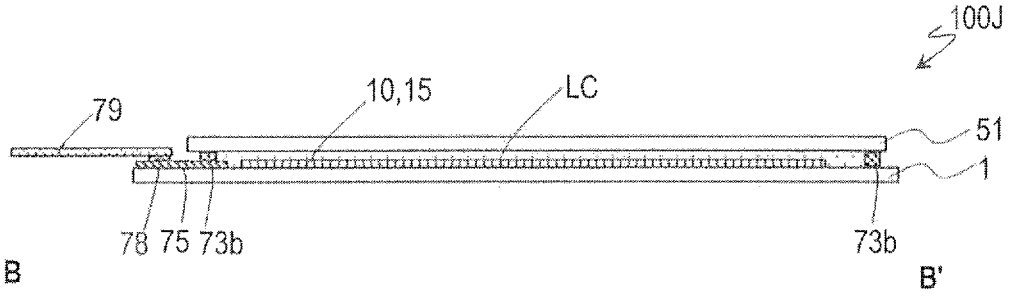
FIG. 16B is a cross-sectional view schematically illustrating the liquid crystal panel 100J.
Figure 16C:
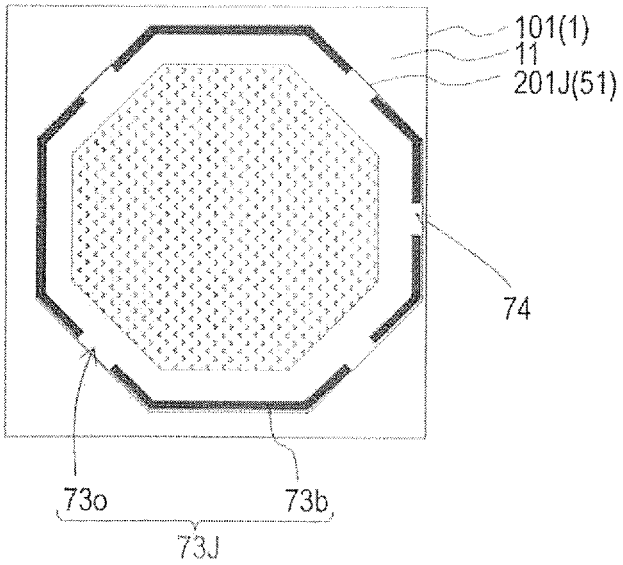
FIG. 16C is a schematic diagram for explaining a seal portion 73J of the liquid crystal panel 100J.
Figure 16D:
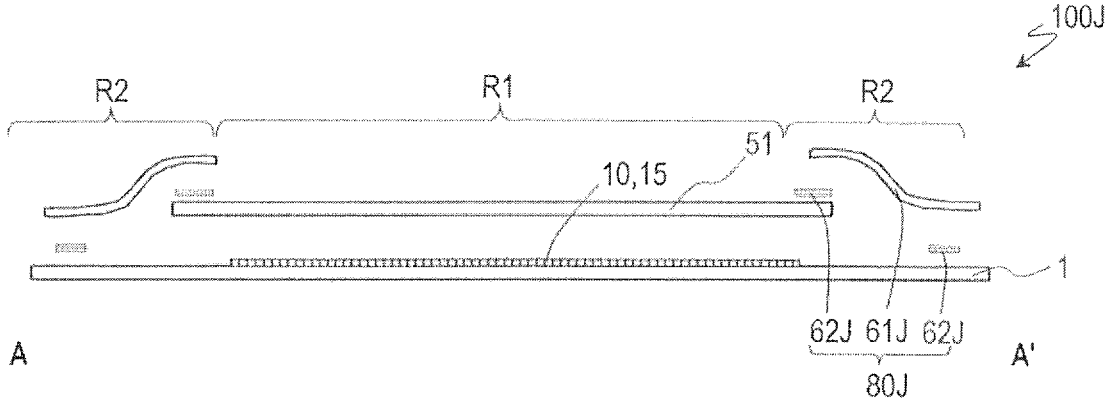
FIG. 16D is a diagram schematically illustrating an exploded cross-section of the liquid crystal panel 100J.
Figure 16E:
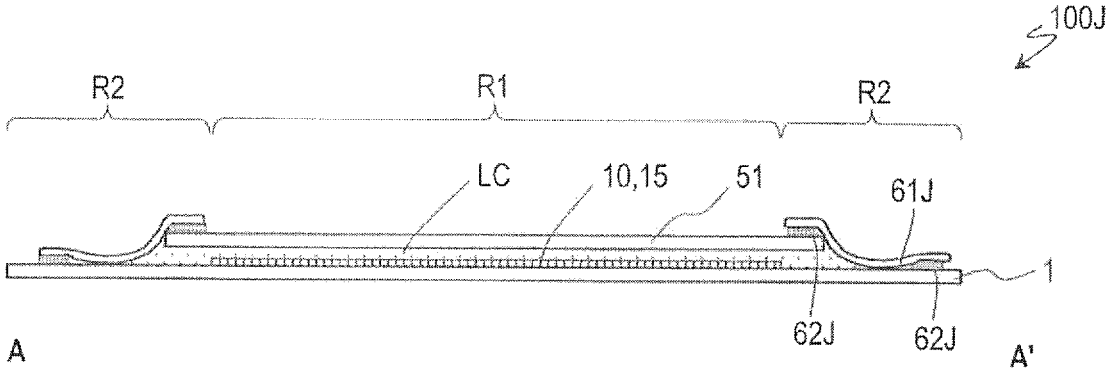
FIG. 16E is a cross-sectional view schematically illustrating the liquid crystal panel 100J.
Figure 16F:
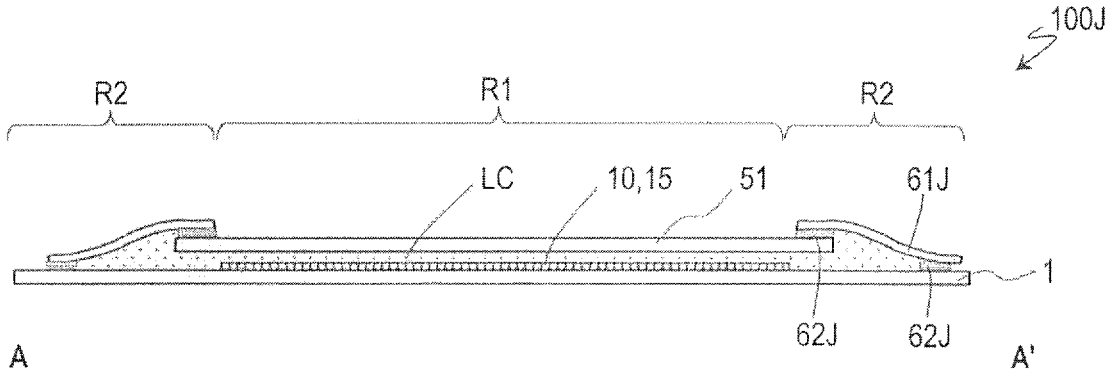
FIG. 16F is a cross-sectional view schematically illustrating the liquid crystal panel 100J.
Figure 16G:
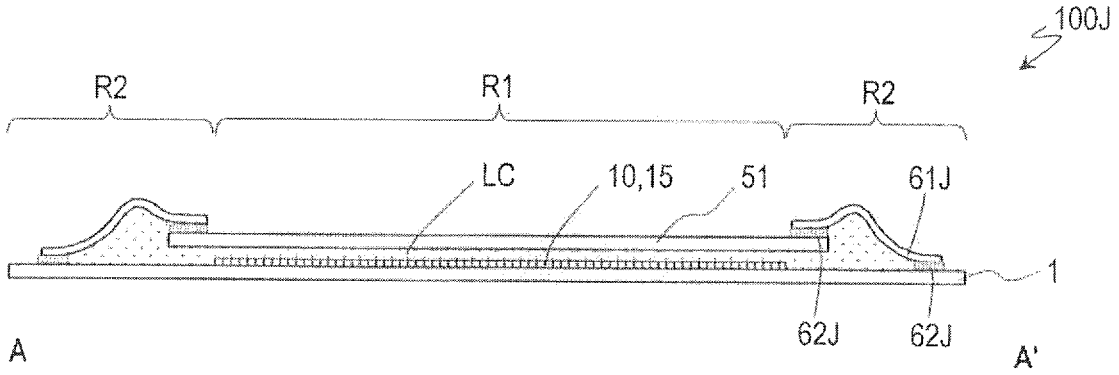
FIG. 16G is a cross-sectional view schematically illustrating the liquid crystal panel 100J.

A liquid crystal panel 100J used in a liquid crystal device according to a third embodiment of the disclosure will be described with reference to FIGS. 16A, 16B, 16C, 16D, 16E, 16F, and 16G. FIG. 16A is a plan view schematically illustrating the liquid crystal panel 100J. FIG. 16B is a cross-sectional view schematically illustrating a cross-section taken along the line B-B' in FIG. 16A. FIG. 16C is a plan view schematically illustrating the liquid crystal panel 100J and is a schematic diagram for explaining a seal portion 73J. FIGS. 16D, 16E, 16F, and 16G are cross-sectional views schematically illustrating a cross-section taken along the line A-A' in FIG. 16A, where FIG. 16D schematically illustrates the cross-section in an exploded manner. FIG. 16E illustrates the liquid crystal panel 100J at, for example, room temperature. FIG. 16F illustrates the liquid crystal panel 100J at an environmental temperature higher than that in FIG. 16E. FIG. 16G illustrates the liquid crystal panel 100J at an even higher environmental temperature than that in FIG. 16F.

As illustrated in FIG. 16A, when viewed from the normal direction of the first dielectric substrate 1 or the second dielectric substrate 51, the first dielectric substrate 1 includes a protrusion 11 that does not overlap the second dielectric substrate 51. A sheet 61J is joined to the protrusion 11 of the first dielectric substrate 1 and the second dielectric substrate 51 via a joining section 62J. A buffer portion 80J of the liquid crystal panel 100J includes the sheet 61J and the joining section 62J. In this example, the sheet 61J deforms more easily due to external force than the first dielectric substrate 1 and the second dielectric substrate 51 in the transmission and/or reception region R1. The buffer portion 80J deforms more easily due to external force than the first dielectric substrate 1 and the second dielectric substrate 51 in the transmission and/or reception region R1.

As illustrated in FIGS. 16F and 16G, when the liquid crystal material constituting the liquid crystal layer LC expands, the buffer portion 80J deforms more greatly than the first dielectric substrate 1 and the second dielectric substrate 51 in the transmission and/or reception region R1 and thus acts to suppress changes in the thickness of the liquid crystal layer LC in the transmission and/or reception region R1. In a scanning antenna including the liquid crystal panel 100J, changes in the thickness of the liquid crystal layer LC between the patch electrode 15 and the slot electrode 55 are suppressed, thereby suppressing decrease in antenna performance. In a liquid crystal device including the liquid crystal panel 100J, changes in the thickness of the liquid crystal layer LC in the effective region R1 are suppressed, and hence influence on the function of the liquid crystal device caused by changes in the thickness of the liquid crystal layer LC is reduced.

Here, as illustrated in FIGS. 16A and 16C, the seal portion 73J and the joining section 62J constitute the sealing seal portion SS. The seal portion 73J includes: a plurality of portions 73*b* provided around the transmission and/or reception region R1; and openings 73*o* formed between adjacent portions 73*b*. The seal portion 73J further includes an injection port 74 and an end seal portion (not illustrated) that seals the injection port 74. The joining section 62J is disposed at a peripheral portion of the sheet 61J (a portion at or near the end of the sheet 61J) to close the opening 73*o*. The joining section 62J is arranged to allow the liquid crystal material to move from the transmission and/or reception region R1 to between the sheet 61J and the protrusion 11 of the first dielectric substrate 1. The joining section 62 is disposed on the dielectric substrate 51 and on the protrusion 11 of the dielectric substrate 1, across a step having the same thickness as the dielectric substrate 51. In the step portion having the same thickness as the dielectric substrate 51, the joining section 62 is appropriately reinforced, and the liquid crystal material is sealed.

As illustrated in FIG. 16E, the liquid crystal material may not be present between the sheet 61J and the dielectric substrate 1 right after the liquid crystal layer LC is formed. However, it poses no problems, provided that at least the transmission and/or reception region R1 is filled with the liquid crystal material. Then, as the volume of liquid crystal material increases, the liquid crystal material can move between the sheet 61J and the dielectric substrate 1. The area of the liquid crystal layer LC when viewed from the normal direction of the first dielectric substrate 1 or the second dielectric substrate 51 may increase as the volume of the liquid crystal material increases. Thus, the sealing seal portion SS formed of the seal portion 73J and the joining section 62J defines the maximum value of the area of the liquid crystal layer LC when viewed from the normal direction of the first dielectric substrate 1 or the second dielectric substrate 51.

Herein, an example is given in which the first dielectric substrate 1 includes the protrusion 11 that does not overlap the second dielectric substrate 51, but embodiments of the disclosure are not limited thereto. The second dielectric substrate 51 may have a protrusion that does not overlap the first dielectric substrate 1, and the sheet may be joined to the protrusion of the second dielectric substrate 51 and the first dielectric substrate 1 via the joining section. It is sufficient that at least one protrusion is provided.

The liquid crystal panel 100J may be manufactured by modifying the manufacturing method according to the previous embodiment.

First, the TFT substrate 101 and a slot substrate 201J are bonded by forming the seal portion 73J (excluding the end seal portion).

Then, the sheet 61J is bonded to the TFT substrate 101 and the slot substrate 201J by forming the joining section 62J.

Thereafter, the liquid crystal layer LC is formed using vacuum injection.

Then, a thermosetting-type encapsulant is applied to close the injection port 74, and the encapsulant is heated at a predetermined temperature for a predetermined time, to thereby cure the encapsulant and form the end seal portion.

Thus, the liquid crystal panel 100J is manufactured.

A scanning antenna according to the embodiments of the disclosure may be prepared by tiling a plurality of scanning antenna portions such as described in, for example, WO 2017/065088 filed by the present applicant. For example, the scanning antenna can be prepared by dividing the liquid crystal panels of the scanning antenna. The liquid crystal panels of the scanning antenna each include: a TFT substrate; a slot substrate; and a liquid crystal layer provided therebetween. The air layer (or other dielectric layer) 54 and the reflective conductive plate 65 may be provided in common across the plurality of scanning antenna portions. When a scanning antenna according to an embodiment of the disclosure is prepared by tiling a plurality of scanning antenna portions, the above-described embodiment may be applied to liquid crystal panels corresponding to each of the scanning antenna portions.

The embodiments according to the disclosure are applied to scanning antennas for satellite communication or satellite broadcasting that are mounted on mobile bodies (ships, aircraft, and automobiles, for example) or to the manufacture thereof. Embodiments of the disclosure are also suitably and broadly used in liquid crystal devices such as liquid crystal display devices and scanning antennas.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

The invention claimed is:

1. A scanning antenna comprising:

a transmission and/or reception region including a plurality of antenna units;

a non-transmission and/or reception region other than the transmission and/or reception region;

a TFT substrate including a first dielectric substrate and, supported by the first dielectric substrate, a plurality of TFTs, a plurality of gate bus lines, a plurality of source bus lines, and a plurality of patch electrodes;

a slot substrate including a second dielectric substrate, and a slot electrode formed on a first main surface of the second dielectric substrate and including a plurality of slots arranged corresponding to the plurality of patch electrodes;

a liquid crystal layer provided between the TFT substrate and the slot substrate and in all of the transmission and/or reception region and a portion of the non-transmission and/or reception region;

a sealing seal portion surrounding the liquid crystal layer and configured to define a maximum value of area of the liquid crystal layer when viewed from a normal direction of the first dielectric substrate or the second dielectric substrate;

a cell gap control seal portion configured to define a minimum value of thickness of the liquid crystal layer in the transmission and/or reception region;

a reflective conductive plate disposed opposing a second main surface of the second dielectric substrate on a side opposite the first main surface via a dielectric layer; and at least one buffer portion provided in contact with the liquid crystal layer in the non-transmission and/or reception region and deforming more easily due to external force than the first dielectric substrate and the second dielectric substrate in the transmission and/or reception region, wherein the at least one buffer portion includes a sheet and a joining section configured to join the sheet and the first dielectric substrate or the second dielectric substrate, and the sheet deforms more easily due to external force than the first dielectric substrate and the second dielectric substrate in the transmission and/or reception region, and/or at least a portion of the joining section deforms more easily due to external force than the cell gap control seal portion.

2. The scanning antenna according to claim 1, further comprising:

a plurality of columnar spacers provided in the transmission and/or reception region, wherein the cell gap control seal portion is configured to define a minimum value of thickness of the liquid crystal layer in the transmission and/or reception region together with the plurality of columnar spacers.

3. The scanning antenna according to claim 1, wherein the sealing seal portion is configured to define a minimum value of thickness of the liquid crystal layer in the non-transmission and/or reception region.

4. The scanning antenna according to claim 3, wherein a minimum value of thickness of the liquid crystal layer in the transmission and/or reception region defined by the cell gap control seal portion and a minimum value of thickness of the liquid crystal layer in the non-transmission and/or reception region defined by the sealing seal portion are substantially equal.

5. The scanning antenna according to claim 3, wherein the sealing seal portion includes the cell gap control seal portion.

6. The scanning antenna according to claim 1, wherein at least a portion of the sealing seal portion deforms more easily due to external force than the cell gap control seal portion, and the at least one buffer portion further includes the at least a portion of the sealing seal portion.

7. The scanning antenna according to claim 1, wherein the cell gap control seal portion is disposed in the non-transmission and/or reception region inward of the sealing seal portion and includes a plurality of portions arranged discretely around the transmission and/or reception region and an opening between adjacent portions among the plurality of portions.

8. The scanning antenna according to claim 1, wherein the sheet includes any one of a polymer film, a thin metal film, or a glass sheet.

9. The scanning antenna according to claim 1, wherein in the non-transmission and/or reception region, the first dielectric substrate or the second dielectric substrate includes at least one thin portion at which thickness of the first dielectric substrate or the second dielectric substrate is smaller than a thickness in the transmission and/or reception region, the at least one buffer portion further includes the at least one thin portion, and the sheet overlaps the at least one thin portion when viewed from the normal direction of the first dielectric substrate or the second dielectric substrate.

10. The scanning antenna according to claim 9, wherein the at least one thin portion entirely overlaps the joining section and the sheet when viewed from the normal direction of the first dielectric substrate or the second dielectric substrate.

11. The scanning antenna according to claim 9, wherein the second dielectric substrate includes the at least one thin portion, and the second main surface of the second dielectric substrate includes at least one recessed portion defining the at least one thin portion.

12. The scanning antenna according to claim 1, wherein the first dielectric substrate or the second dielectric substrate includes at least one through-hole in the non-transmission and/or reception region, and the sheet covers the at least one through-hole.

13. The scanning antenna according to claim 12, wherein the sheet is disposed further from the liquid crystal layer than the first dielectric substrate or the second dielectric substrate formed with the at least one through-hole.

14. The scanning antenna according to claim 13, wherein the sealing seal portion includes at least a portion of the joining section.

15. The scanning antenna according to claim 13, wherein the at least a portion of the joining section deforms more easily due to external force than the cell gap control seal portion.

16. The scanning antenna according to claim 12, wherein the sheet is disposed closer to the liquid crystal layer than the first dielectric substrate or the second dielectric substrate formed with the at least one through-hole.

17. The scanning antenna according to claim 16, wherein a surface of the sheet closer to the liquid crystal layer includes a plurality of protruding portions and/or a plurality of recessed portions in contact with the liquid crystal layer.

18. The scanning antenna according to claim 1, wherein one of the first dielectric substrate and the second dielectric substrate includes at least one protrusion that does not overlap the other of the first dielectric substrate and the second dielectric substrate when viewed from the normal direction of the first dielectric substrate or the second dielectric substrate, and the sheet is joined to the at least one protrusion and the other of the first dielectric substrate and the second dielectric substrate via the joining section.

19. The scanning antenna according to claim 18, wherein the sealing seal portion includes at least a portion of the joining section.

20. A liquid crystal device comprising:

an effective region and a non-effective region located in a region other than the effective region;

a first substrate including a first dielectric substrate;

a second substrate including a second dielectric substrate;

a liquid crystal layer provided between the first substrate and the second substrate and in all of the effective region and a portion of the non-effective region;

a sealing seal portion surrounding the liquid crystal layer and configured to define a maximum value of area of the liquid crystal layer when viewed from a normal direction of the first dielectric substrate or the second dielectric substrate;

a cell gap control seal portion configured to define a minimum value of thickness of the liquid crystal layer in the effective region; and at least one buffer portion provided in contact with the liquid crystal layer in the non-effective region and deforming more easily due to external force than the first dielectric substrate and the second dielectric substrate in the effective region, wherein the at least one buffer portion includes a sheet and a joining section joining the sheet and the first dielectric substrate or the second dielectric substrate, and the sheet deforms more easily due to external force than the first dielectric substrate and the second dielectric substrate in the effective region, and/or at least a portion of the joining section deforms more easily due to external force than the cell gap control seal portion.

* * * * *